US011603178B2

(12) United States Patent
Ideskog

(10) Patent No.: US 11,603,178 B2
(45) Date of Patent: Mar. 14, 2023

(54) METHOD AND SYSTEM FOR CONTROLLING PROPULSIVE POWER OUTPUT OF SHIP

(71) Applicant: YARA MARINE TECHNOLOGIES AS, Oslo (NO)

(72) Inventor: Linus Ideskog, Öckerö (SE)

(73) Assignee: YARA MARINE TECHNOLOGIES AS, Oslo (NO)

( * ) Notice: Subject to any disclaimer, the term of this patent is extended or adjusted under 35 U.S.C. 154(b) by 0 days.

(21) Appl. No.: 17/622,932

(22) PCT Filed: Jul. 1, 2020

(86) PCT No.: PCT/EP2020/068509
§ 371 (c)(1),
(2) Date: Dec. 27, 2021

(87) PCT Pub. No.: WO2021/001419
PCT Pub. Date: Jan. 7, 2021

(65) Prior Publication Data

US 2022/0242536 A1 Aug. 4, 2022

(30) Foreign Application Priority Data

Jul. 3, 2019 (SE) ..... 1950839-9

(51) Int. Cl.
*B63H 3/10* (2006.01)
*B63H 21/22* (2006.01)
(Continued)

(52) U.S. Cl.
CPC ..... *B63H 3/10* (2013.01); *B63H 21/14* (2013.01); *B63H 21/21* (2013.01); *B63H 21/22* (2013.01);
(Continued)

(58) Field of Classification Search
CPC ..... B63H 3/10; B63H 21/14; B63H 21/21; B63H 21/22; B63H 2021/216;
(Continued)

(56) References Cited

U.S. PATENT DOCUMENTS 5,070,832 A * 12/1991 Hapka ..... F02D 17/04 123/333
5,392,741 A * 2/1995 Uzkan ..... F01P 11/14 290/40 C
(Continued)

FOREIGN PATENT DOCUMENTS

JP S61291296 A 12/1986
WO 2016169991 A1 10/2016
WO 2019086086 A1 5/2019

OTHER PUBLICATIONS

International Preliminary Report on Patentability for App. No. PCT/EP2020/068509, dated Dec. 3, 2021, 26 pages.
(Continued)

*Primary Examiner* — John M Zaleskas
(74) *Attorney, Agent, or Firm* — Dilworth IP, LLC

(57) ABSTRACT

A method and a system for controlling a propulsive power output applied to a propeller shaft of a ship. The ship includes the propeller shaft and a propulsive power source connected to the propeller shaft. A control signal for producing with the propulsive power source a propulsive power is varied within an interval limited by an upper control limit value and a lower control limit value. If a current value of an operational parameter of the ship reaches a first parameter limit value, the upper control limit value is reduced. Thus, the propulsive power source may be prevented from applying a too high power output to the propeller shaft, which would be unfavourable for the ship.

19 Claims, 3 Drawing Sheets

(51) Int. Cl.

| | |
|---|---|
| ***B63H 23/12*** | (2006.01) |
| ***F02D 41/00*** | (2006.01) |
| ***B63H 21/14*** | (2006.01) |
| ***B63H 21/21*** | (2006.01) |
| ***F02D 41/14*** | (2006.01) |
| ***F02B 37/12*** | (2006.01) |
| *F02D 25/00* | (2006.01) |
| *F02D 29/02* | (2006.01) |
| *F02D 41/22* | (2006.01) |

(52) U.S. Cl.
CPC ..... *B63H 23/12* (2013.01); *F02B 37/12* (2013.01); *F02D 41/0007* (2013.01); *F02D 41/1406* (2013.01); *B63H 2021/216* (2013.01); *F02D 25/00* (2013.01); *F02D 29/02* (2013.01); *F02D 41/1446* (2013.01); *F02D 41/22* (2013.01); *F02D 2200/021* (2013.01); *F02D 2200/0406* (2013.01); *F02D 2200/0414* (2013.01); *F02D 2200/0625* (2013.01); *F02D 2250/26* (2013.01)

(58) Field of Classification Search
CPC ..... B63H 23/12; F02D 2200/021; F02D 2200/022; F02D 2200/0406; F02D 2200/0408; F02D 2200/0414; F02D 2250/18; F02D 2250/26; F02D 29/02; F02D 25/00; F02D 41/0007; F02D 41/04; F02D 41/1446
See application file for complete search history.

(56) References Cited

U.S. PATENT DOCUMENTS

| | | | | |
|---|---|---|---|---|
| 6,401,457 | B1 * | 6/2002 | Wang | F02B 37/18 73/114.37 |
| 6,415,761 | B1 * | 7/2002 | McKenzie | F02D 41/22 123/41.15 |
| 9,868,501 | B1 * | 1/2018 | Gable | B63H 21/213 |
| 11,352,118 | B1 * | 6/2022 | Dengel | B63H 21/21 |
| 2002/0099496 | A1 * | 7/2002 | Weisman, II | B60W 30/18054 701/115 |
| 2002/0162533 | A1 * | 11/2002 | Houchin | F02D 41/1497 123/352 |
| 2004/0121666 | A1 | 6/2004 | Okuyama | |
| 2005/0049819 | A1 * | 3/2005 | Longnecker | F02D 41/1497 702/132 |
| 2006/0042241 | A1 * | 3/2006 | Bright | E02F 9/2246 60/431 |
| 2006/0100755 | A1 * | 5/2006 | Kustosch | B60W 30/146 701/22 |
| 2007/0293103 | A1 * | 12/2007 | Kinoshita | F02D 11/02 440/1 |
| 2009/0151337 | A1 * | 6/2009 | Tornambe | F01N 11/002 60/311 |
| 2010/0168942 | A1 * | 7/2010 | Noffsinger | G05D 1/0206 715/764 |
| 2010/0274420 | A1 * | 10/2010 | Veit | B63H 3/10 440/75 |
| 2012/0277941 | A1 * | 11/2012 | Noffsinger | G08G 3/00 701/21 |
| 2014/0067236 | A1 * | 3/2014 | Henry | F02D 41/0052 60/602 |
| 2014/0336852 | A1 * | 11/2014 | Ozolins | B63H 21/22 701/21 |
| 2015/0219034 | A1 * | 8/2015 | Boettcher | F02D 41/2422 123/349 |
| 2017/0051692 | A1 * | 2/2017 | Zhang | F02D 25/00 |
| 2017/0129511 | A1 * | 5/2017 | Crane | B61L 15/0036 |
| 2017/0268439 | A1 * | 9/2017 | Ahuja | F04D 27/001 |
| 2018/0001985 | A1 * | 1/2018 | Zhang | F02D 41/26 |
| 2018/0050782 | A1 * | 2/2018 | Danielsson | B63H 21/14 |
| 2018/0148034 | A1 * | 5/2018 | Ideskog | B63H 21/21 |
| 2018/0306125 | A1 * | 10/2018 | Renold-Smith | F02C 9/46 |
| 2018/0313282 | A1 * | 11/2018 | Pati | F02D 41/1406 |
| 2018/0327052 | A1 * | 11/2018 | Van Miert | B63B 71/00 |
| 2019/0140454 | A1 * | 5/2019 | Chase | H02K 7/1807 |
| 2019/0301360 | A1 | 10/2019 | Murakami | |
| 2020/0039623 | A1 * | 2/2020 | Mikalsen | B63H 21/20 |
| 2020/0056558 | A1 * | 2/2020 | Weber | F02M 55/025 |
| 2020/0149996 | A1 * | 5/2020 | Seenumani | F02B 63/047 |
| 2020/0223522 | A1 * | 7/2020 | Ideskog | F02D 41/1463 |
| 2022/0242535 | A1 * | 8/2022 | Ideskog | B63H 21/22 |

OTHER PUBLICATIONS

International Search Report for App. No. PCT/EP2020/068509, dated Oct. 6, 2020, 4 pages.
Written Opinion for App. No. PCT/EP2020/068509, dated Oct. 6, 2020, 7 pages.
Claudiu Nichita: "X-DF TEchnology", SNAME, Jan. 9, 2018 (Jan. 9, 2018), XP55733787, Retrieved from the Internet: URL:https://higherlogicdownload.s3.amazonaws.com/SNAME/442597fa-7d01-48c2-83e8-dfe93adfd043/UploadedFiles/RXmW7oXDTAuLHIInsjhd_20180109%20X-DP/020Technology/020@/020SNAME,/020London/0202018.pdf [retrieved on Sep. 24, 2020].
"Dynamic Cylinder Cutout", Research Disclosure, Kenneth Mason Publications, Hampshire, UK, GB, vol. 611, No. 33, Mar. 1, 2015 (Mar. 1, 2015), p. 7, XP007143917, ISSN: 0374-4353, (retrieved on Feb. 5, 2015).
International Preliminary Report on Patentability for App. No. PCT/EP2020/068505, dated Dec. 3, 2021, 30 pages.
International Search Report for App. No. PCT/EP2020/068505, dated Oct. 13, 2020, 4 pages.
Written Opinion for App. No. PCT/EP2020/068505, dated Oct. 13, 2020, 7 pages.
Office Action dated Jun. 13, 2022 for U.S. Appl. No. 17/622,913 (pp. 1-11).
Office Action (Final Rejection) dated Sep. 19, 2022 for U.S. Appl. No. 17/622,913 (pp. 1-13).
SG Written Opinion issued in App. No. SG11202113722Y, dated Sep. 22, 2022, 6 pages.

* cited by examiner

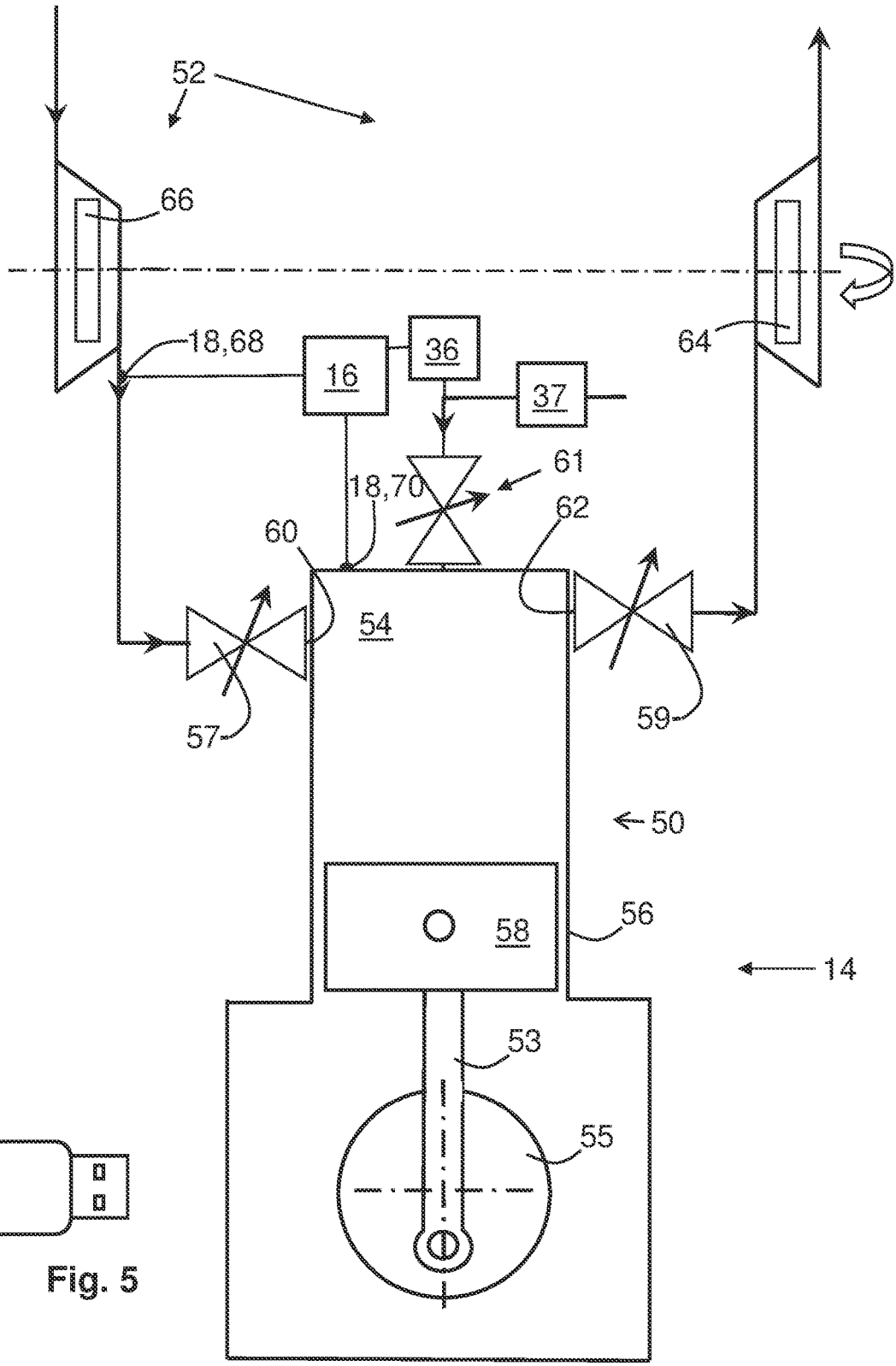
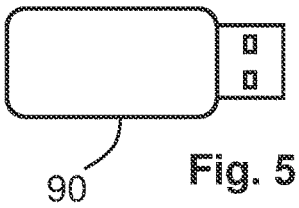
Fig. 5
Fig. 3

METHOD AND SYSTEM FOR CONTROLLING PROPULSIVE POWER OUTPUT OF SHIP

TECHNICAL FIELD

The invention relates to a method for controlling a propulsive power output applied to a propeller shaft of a ship, and to a system for controlling a propulsive power output applied to a propeller shaft of a ship. The invention also relates to a ship comprising a system for controlling a propulsive power output applied to a propeller shaft of the ship. The invention further relates to a computer program and a computer-readable storage medium comprising instructions which, when executed by a computer, cause the computer to carry out a method for controlling a propulsive power output applied to a propeller shaft of a ship.

BACKGROUND

A ship comprises a propulsive power source which is connected with a propeller via inter alia a propeller shaft. In this manner, the propulsive power source is arranged to propel the ship.

The propulsive power source comprises at least one internal combustion engine, ICE. The ship is a large ship used e.g. in commercial traffic, such as e.g. a tanker, a RORO vessel, a passenger ferry, or a coastal vessel just to name a few examples.

The propulsion of the ship is controlled from its bridge. There, personnel have access to support information for controlling the ship. The information may be provided e.g. via one or more of maps, instruments, and ship internal communication devices. Control devices for controlling speed and course of the ship are also provided on the bridge.

WO2019/011779 discloses a user board and a control unit for controlling the propulsion of a ship comprising an engine and a controllable pitch propeller. Torque and engine speed are adjusted to correspond to an output setpoint value. The adjustment is such that said ship is operated in an operating condition with an engine speed of said engine and a propeller pitch of said controllable pitch propeller such that the fuel consumption of said ship is brought and/or held within a desired fuel consumption range. The output setpoint value may be set using the user board. Claudiu Nichita: "X_DF Technology", SNAME, 9 Jan. 2018, XP055733787, discloses inter alia engine rating fields of marine diesel engines. WO 2019/086086 relates to a method for propulsion control by means of an add on propulsion control system (PCS) that is designed to cooperate with an already existing PCS/RCS solution with the purpose of minimizing the fuel consumption during propulsion of larger ships.

SUMMARY

It would be advantageous to achieve a method and/or a system for controlling a propulsive power applied to the propeller shaft of a ship. In particular, it would be desirable to provide a method and/or system being adaptive to operating conditions of the ship. To better address one or more of these concerns, a method and/or a system having the features defined in the independent claims is provided.

According to an aspect of the invention, there is provided a method for controlling a propulsive power output applied to a propeller shaft of a ship according to claim 1.

The ship comprises the propeller shaft and a propulsive power source connected to the propeller shaft. The method comprises steps of:

- applying a control signal to the propulsive power source,
- producing with the propulsive power source a propulsive power in correspondence with the control signal,
- varying the control signal within an interval limited by an upper control limit value and a lower control limit value,
- determining a current value of an operational parameter of the ship,
- comparing the current value of the operational parameter with a first parameter limit value, wherein if the current value of the operational parameter reaches the first parameter limit value, the method comprises a step of:
- reducing the upper control limit value.

Since the method comprises the step of reducing the upper control limit value, if the current value of the operational parameter of the ship reaches the first parameter limit value, the method for controlling the propulsive power output takes account of the operating conditions of the ship for preventing the propulsive power source from applying a too high power output to the propeller shaft, which would be unfavourable for the ship.

According to a further aspect of the invention, there is provided a system for controlling a propulsive power output applied to a propeller shaft of a ship according to independent claim 13.

The system comprises the propeller shaft, a propulsive power source, and a control arrangement. The control arrangement comprises at least one control unit, and at least one sensor for sensing at least one operational characteristic of the ship. The control arrangement is configured to:

- apply a control signal to the propulsive power source for controlling the power output applied to the propeller shaft by the propulsive power source, wherein the control signal is variable within an interval limited by an upper control limit value and a lower control limit value,
- determine a current value of an operational parameter of the ship utilising the at least one sensor, and
- compare the current value of the operational parameter with a first parameter limit value. If the current value of the operational parameter reaches the first parameter limit value, the control arrangement is configured to:
- reduce the upper control limit value.

Similarly, as discussed above in connection with the method, since the control arrangement of the system is configured to reduce the upper control limit value, if the current value of the operational parameter of the ship reaches the first parameter limit value, the system for controlling the propulsive power output takes account of the operating conditions of the ship for preventing the propulsive power source from applying a too high power output to the propeller shaft, which would be unfavourable for the ship.

The first parameter limit value represents a value of the operational parameter of the ship indicating that the propulsive power source is operated at too high a power output level. The first parameter limit value may relate to one or more of various aspects of the ship, such as a load affecting to the propeller shaft of the ship, the conditions under which the ship is traveling a sea, the propulsive power source, the cargo aboard the ship, etc.

More specifically, the propulsive power source, which is connected to the propeller shaft of the ship, provides propulsive power to the propeller shaft within a power window.

The power window is defined by the interval limited by the upper and lower power limit values. As the ship travels, i.e. as the ship is propelled by the propulsive power source, the current propulsive power output applied to the propeller shaft from the propulsive power source is monitored and the propulsive power source is controlled such that the propulsive power applied to the propeller shaft remains within the power window. The upper and lower power limit values, i.e. the size of the power window, may be set based on one or more of a number of different aspects of the ship. According to the invention, the first parameter limit value is utilised for adjusting an upper limit of the power window, based on at least one aspect of the ship. Thus, current conditions affecting a particular aspect of the ship are utilised for limiting the power window.

In practice, this means that the propulsive power source is controlled such that the propulsive power applied to the propeller shaft may be prevented from exceeding the upper power limit value and from falling below the lower power limit value, at least not for any longer periods of time. The system for controlling the propulsive power output applied to the propeller shaft of the ship is utilised by personnel on the bridge of the ship for controlling the propulsive power source for restricting the propulsive power applied to be propeller shaft within the power window. The system may form a support system for the personnel and/or the system may form part of an autopilot system of the ship. The system may be switched off, disconnected, or disabled if personnel so deems appropriate, e.g. during manoeuvring in a harbour.

Examples of traditionally used control means aboard a ship are direct communication between personnel on the bridge and engine operating personnel in an engine room of the ship, and internal combustion engine, ICE, internal safety systems which automatically prevent the ICE of the propulsive power source from exceeding a maximum ICE parameter.

It has been realised by the inventor that it would be beneficial if not only the power output applied by the propulsive power source to the propeller shaft is controlled within a power window, i.e. within the interval limited by the upper control limit value and the lower control limit value, but if the size of the power window also would be adaptable to current conditions under which the ship is operated. Namely, depending on current operating conditions of the ship, the power window may be unfavourably sized and would benefit from being adjusted in size.

More specifically, under particular operating conditions of the ship, such as e.g. under particular sea and/or weather conditions, applying a propulsive power output to the propeller shaft close to the upper power limit value, may prove to be unfavourable for the ship, propulsive power source, and/or cargo, and/or may cause the propulsive power source to operate inefficiently, in an environmentally harmful manner, and/or erratically. Whereas, under other operating conditions of the ship, the same upper power limit value would prove to be favourable for the ship, propulsive power source, and/or cargo, and/or would provide efficient, environmentally friendly, and/or reliable operation of the propulsive power source.

Thus, in accordance with the invention, by comparing the current value of the operational parameter of the ship with the first parameter limit value, and if the current value of the operational parameter reaches the first parameter limit value, reducing the upper control limit value, unfavourable operation of the ship is prevented by reducing the power output of the propulsive power source.

The ship may be a large ship used e.g. in commercial traffic, such as e.g. a tanker, a RORO vessel, a passenger ferry, or a coastal vessel. The length of the ship may be at least 90 m. Typically, deadweight tonnage of the ship may be at least 4200 tonnes. The maximum power output of the propulsive power source may be at least 3 MW. The maximum power output of the propulsive power source may be within a range of 3-85 MW. The maximum power output of an ICE of the propulsive power source may be at least 2 MW. However, the invention may be applicable also in smaller ships than discussed above.

The propulsive power source comprises at least one ICE. According to some embodiments, the propulsive power source comprises at least one further ICE, i.e. at least two ICEs, connected to the propeller shaft.

The control arrangement may be dedicated for performing the control of the propulsive power output applied to a propeller shaft discussed herein. Alternatively, the control arrangement may be configured for performing further control tasks related to the propulsion of the ship and/or to the propulsive power source. Similarly, the control unit may be a dedicated control unit for performing the control discussed herein. Alternatively, the control unit may be configured for performing further control tasks. According to a further alternative, the control unit may be a distributed control unit, i.e. it may comprise more than one processor or similar device, which are configured to collectively perform the control discussed herein.

The varying of the control signal within the interval limited by the upper and a lower control limit values is performed when the ship travels and the propulsive power of the propulsive power source is controlled by personnel or an autopilot of the ship in order to adapt the speed of the ship to a desired ship speed.

The current value of the propulsive power may alternatively be referred to as the momentary value of the propulsive power or the prevailing value of the propulsive power. Similarly, the current value of the operational parameter may alternatively be referred to as the momentary value of the operational parameter or the prevailing value of the operational parameter.

The sensor for sensing at least one operational characteristic of the ship may be at least partially utilised for determining the current value of the operational parameter of the ship.

The first parameter limit value represents a value of the operational parameter of the ship, which value indicates that the ship is operated at an upper limit of an operational characteristic of the ship, which, if exceeded could be unfavourable for at least one of the ship, propulsive power source, and/or cargo, and/or may cause the propulsive power source to operate inefficiently, in an environmentally harmful manner, and/or erratically. Depending on the particular operational parameter, exceeding or falling below the first parameter limit value indicates that the operational parameter has reached a value indicating the upper limit of the operational characteristic of the ship. See further below with reference to the discussion of the various example operational parameters.

Accordingly, the term reaches, in the context of that the current value of the operational parameter of the ship reaches the first parameter limit value, means that the operational parameter equals, exceeds, or falls below, the first parameter limit value. The operational parameter of the ship reaches the first parameter limit value from a previous level of the operational parameter of the ship being within a medium range of the operational parameter, i.e. from a medium range of the operational characteristic of the ship. Thus, depending on the relevant operational parameter, the current value of the operational parameter exceeding or falling below the first parameter limit value, may cause the upper control limit value to be reduced. Naturally, in addition, the operational parameter equalling the first parameter limit value, may cause the upper control limit value to be reduced.

According to embodiments, the method may comprise an optional step of:

determining a current value of a further operational parameter of the ship, and the method may comprise a step of:

comparing the current value of the operational parameter or the current value of the further operational parameter with a second parameter limit value, wherein if the current value of the operational parameter or the current value of the further operational parameter reaches the second parameter limit value, the method may comprise a step of:

increasing the lower control limit value. In this manner, the method for controlling the propulsive power output takes account of the operating conditions of the ship for preventing the propulsive power source from applying a too low power output to the propeller shaft, which could be unfavourable for the ship.

The second parameter limit value represents a value of the operational parameter of the ship, or of the further operational parameter of the ship, indicating that the propulsive power source is operated at too low a power output level. The second parameter limit value may relate to one or more of various aspects of the ship, such as the load affecting to the propeller shaft of the ship, the propulsive power source, the cargo aboard the ship, etc.

The second parameter limit value represents a value of the operational parameter, which value indicates that the ship is operated at a lower limit of an operational characteristic of the ship, which, if fallen below could be unfavourable for the ship, propulsive power source, and/or cargo, and/or may cause the propulsive power source to operate inefficiently, in an environmentally harmful manner, and/or erratically. Depending on the particular operational parameter or further operational parameter, falling below or exceeding the second parameter limit value indicates that the operational parameter, or the further operational parameter, has reached a value indicating the lower limit of an operational characteristic of the ship. See further below with reference to the discussion of the various example operational parameters.

Accordingly, the term reaches, in the context of that the current value of the operational parameter of the ship or the further operational parameter of the ship reaching the second parameter limit value, means that the operational parameter or the further operational parameter equals, falls below, or exceeds the second parameter limit value. The operational parameter or the further operational parameter of the ship reaches the second parameter limit value from a previous level of the operational parameter or the further operational parameter of the ship being within a medium range of the operational parameter or the further operational parameter, i.e. from a medium range of the operational characteristic of the ship. Thus, depending on the relevant operational parameter, the current value of the operational parameter or the further operational parameter falling below or exceeding the second parameter limit value, may cause the lower control limit value to be increased. Naturally, in addition, the operational parameter or the further operational parameter equalling the second parameter limit value may cause the lower control limit value to be increased.

As indicated above, the operational parameter that is utilised in the step of comparing the current value of the operational parameter with the second parameter limit value may be the same operational parameter that is utilised in the step of comparing the current value of the operational parameter with the first parameter limit value. Alternatively, the operational parameter that is utilised in the step of comparing the current value of the operational parameter with the second parameter limit value may be a different operational parameter, i.e. the further operational parameter, than that which is utilised in the step of comparing the current value of the operational parameter with the first parameter limit value.

According to embodiments, subsequent to the step of reducing the upper control limit value the method may comprise steps of:

determining a subsequent current value of the operational parameter of the ship, and comparing the subsequent current value of the operational parameter with the first parameter limit value and/or a third parameter limit value.

If the subsequent current value of the operational parameter reaches the first parameter limit value, the method may comprise a step of:

further reducing the upper control limit value, or if the subsequent current value of the operational parameter stays clear of the third parameter limit value, the method may comprise a step of:

increasing the upper control limit value. In this manner, the upper control limit value may be adapted to changing operating conditions of the ship. More specifically, the subsequent current value of the operational parameter of the ship may represent updated current operating conditions of the ship. If the subsequent current value of the operational parameter has changed to such a degree that the first parameter limit value has been reached or the third parameter limit value has not been reached, the upper control limit value may be either further reduced or increased. Accordingly, the size of the power window may be continuously or intermittently adapted to current operating conditions of the ship.

The third parameter limit value represents a value of the operational parameter of the ship, which value indicates that the ship is operated at a distance below the upper limit of an operational characteristic of the ship. Accordingly, the upper control limit value may be increased in order to utilise a large percentage of the power output of the propulsive power source.

Accordingly, the term "stay clear of", in the context of that the current value of the operational parameter of the ship staying clear of the third parameter limit value, means that the operational parameter does not reach the third parameter limit value. The operational parameter of the ship stays clear of the third parameter limit value seen in a direction from a medium range of the operational parameter, i.e. from a medium range of the operational characteristic of the ship. Thus, depending on the relevant operational parameter, the current value of the operational parameter not exceeding or not falling below the third parameter limit value, may cause the upper control limit value to be increased.

The third parameter limit value is closer to a medium range of the operational parameter, i.e. closer to a medium range of the operational characteristic of the ship, than the first parameter limit value.

According to embodiments, subsequent to the step of increasing the lower control limit value the method may comprise steps of:

determining a subsequent current value of the operational parameter of the ship or a subsequent current value of the further operational parameter of the ship, and comparing the subsequent current value of the operational parameter or the subsequent current value of the further operational parameter with the second parameter limit value and/or a fourth parameter limit value.

If the subsequent current value of the operational parameter or the subsequent current value of the further operational parameter reaches the second parameter limit value, the method may comprise a step of:

further increasing the lower control limit value, or if the subsequent current value of the operational parameter or the subsequent current value of the further operational parameter stays clear of the fourth parameter limit value, the method may comprise a step of:

reducing the lower control limit value. In this manner, the lower control limit value may be adapted to changing operating conditions of the ship. More specifically, the subsequent current value of the operational parameter or the subsequent value of the further operational parameter may represent current operating conditions of the ship. If the subsequent current value of the operational parameter or further operational parameter has changed to such a degree that the second parameter limit value has been reached, or the fourth parameter limit value has not been reached, the lower control limit value may be either further increased or reduced. Accordingly, the size of the power window may be continuously or intermittently adapted to current operating conditions of the ship.

The fourth parameter limit value represents a value of the operational parameter or the further operational parameter of the ship, which value indicates that the ship is operated at a distance above the lower limit of an operational characteristic of the ship. Accordingly, the lower control limit value may be reduced in order to utilise a large percentage of a power output range of the propulsive power source.

Accordingly, the term "stay clear of", in the context of that the current value of the operational parameter or the further operational parameter of the ship staying clear of the fourth parameter limit value, means that the operational parameter or the further operational parameter does not reach the fourth parameter limit value. The operational parameter or the further operational parameter of the ship stays clear of the fourth parameter limit value seen in a direction from a medium range of the operational parameter or the further operational parameter, i.e. from a medium range of the operational characteristic of the ship. Thus, depending on the relevant operational parameter, the current value of the operational parameter or the further operational parameter not falling below or not exceeding the fourth parameter limit value, may cause the lower control limit value to be reduced.

The fourth parameter limit value is closer to a medium range of the operational parameter or the further operational parameter, i.e. closer to a medium range of the operational characteristic of the ship, than the second parameter limit value.

According to embodiments, the operational parameter of the ship and/or the further operational parameter of the ship may relate to a load characteristic of the propeller shaft. In this manner, ambient conditions of the ship affecting the propeller shaft and/or ship internal conditions affecting the propeller shaft may be considered when setting the upper and/or lower control limit value/s.

According to embodiments, the operational parameter of the ship and/or the further operational parameter of the ship may relate to ambient conditions affecting the ship. In this manner, ambient conditions of the ship affecting the ship may be considered when setting the upper and/or lower control limit value/s.

According to embodiments, the propulsive power source may comprise an internal combustion engine connected to the propeller shaft. The operational parameter of the ship and/or the further operational parameter of the ship may relate to the internal combustion engine. In this manner, operating conditions of the internal combustion engine may be considered when setting the upper and/or lower control limit value/s.

According to embodiments, the operational parameter of the ship and/or the further operational parameter of the ship may relate to a cargo load characteristic affecting cargo aboard the ship. In this manner, conditions affecting the cargo aboard the ship may be considered when setting of the upper and/or lower control limit value/s.

According to a further aspect of the invention, there is provided a ship comprising a system according to any one of aspects and/or embodiments discussed herein.

According to a further aspect of the invention, there is provided a computer program comprising instructions which, when the program is executed by a computer, cause the computer to carry out the steps of the method according to any one of aspects and/or embodiments discussed herein.

According to a further aspect of the invention, there is provided a computer-readable storage medium comprising instructions which, when executed by a computer, cause the computer to carry out the steps of the method according to any one of aspects and/or embodiments discussed herein.

Further features of, and advantages with, the invention will become apparent when studying the appended claims and the following detailed description.

BRIEF DESCRIPTION OF THE DRAWINGS

Various aspects and/or embodiments of the invention, including its particular features and advantages, will be readily understood from the example embodiments discussed in the following detailed description and the accompanying drawings, in which:

FIG. 5 illustrates a computer-readable storage medium according to embodiments.

DETAILED DESCRIPTION

Aspects and/or embodiments of the invention will now be described more fully. Like numbers refer to like elements throughout. Well-known functions or constructions will not necessarily be described in detail for brevity and/or clarity.

Figure 1:
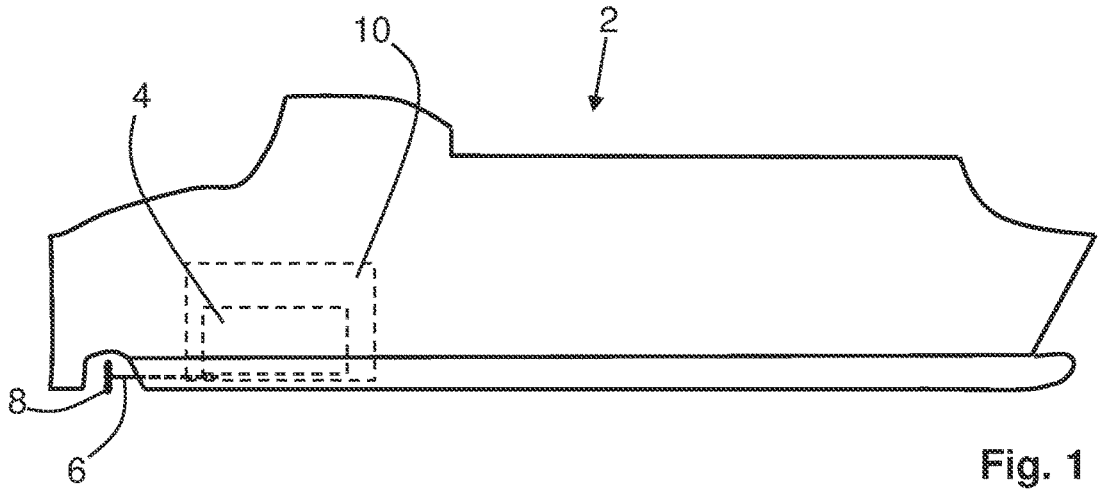
FIG. 1 illustrates a ship according to embodiments.

FIG. 1 illustrates a ship 2 according to embodiments. The ship 2 is configured for use in commercial traffic, such as for passenger transport and/or goods transport.

The ship 2 comprises a propulsive power source 4, a propeller shaft 6, and a propeller 8. The propulsive power source 4 is connected to the propeller shaft 6 and configured for applying a propulsive power output to the propeller shaft 6. The propeller 8 is connected to the propeller shaft 6. Thus, the propulsive power source 4 is arranged to propel the ship 2 via the propeller shaft 6 and the propeller 8.

Further, the ship 2 comprises a system 10 for controlling a propulsive power output applied to the propeller shaft 6. An example of such a system 10 is discussed below with reference to FIG. 2.

In these embodiments, the ship 2 comprises only one propeller shaft 6 and only one propulsive power source 4. In alternative embodiments, the ship 2 may comprise one or more further propeller shafts, and one further propulsive power source connected to each of the one or more further propeller shafts.

Figure 2:
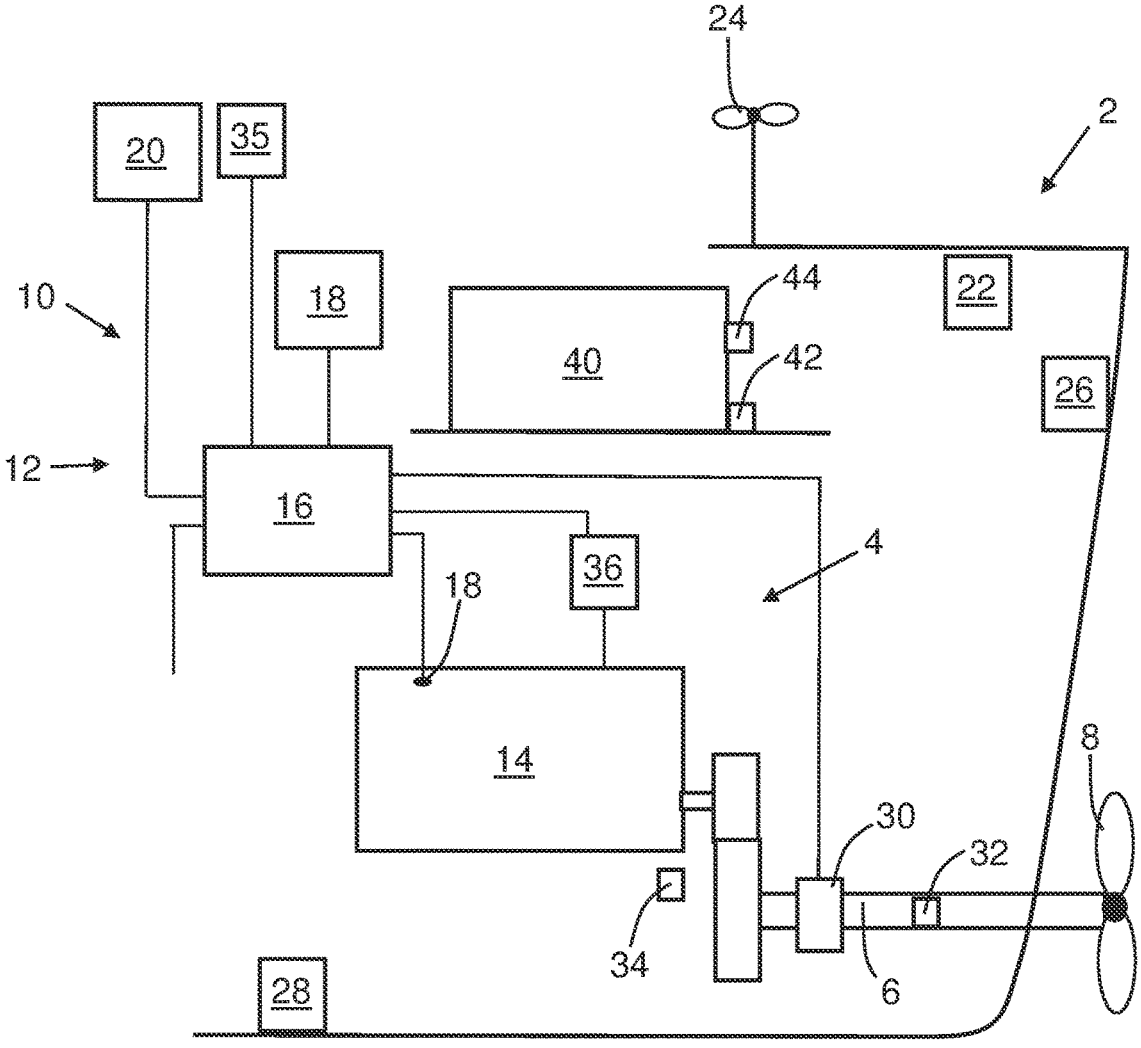
FIG. 2 schematically illustrates embodiments of a system for controlling a propulsive power output applied to a propeller shaft of a ship, FIG. 3 schematically illustrates a cross section through an internal combustion engine.

FIG. 2 schematically illustrates embodiments of a system 10 for controlling a propulsive power output applied to a propeller shaft 6 of a ship 2. The ship 2 may be a ship 2 as discussed above with reference to FIG. 1.

The system 10 comprise a propulsive power source 4, a propeller shaft 6, and a control arrangement 12. The propulsive power source 4 may comprise an internal combustion engine, ICE, 14 connected to the propeller shaft 6. The ICE 14 may be a 2-stroke or a 4-stroke diesel engine.

According to some embodiments, the propulsive power source 4 may comprise a further ICE (not shown) connected to the propeller shaft 6. The further ICE may be a 2-stroke or a 4-stroke diesel engine.

The control arrangement 12 comprises at least one control unit 16, at least one sensor 18, for sensing at least one operational characteristic of the ship 2. In FIG. 2, the at least one sensor 18 has been schematically indicated, at the ICE 14 and separate from the ICE 14 and connected to the control unit 16. Some examples of sensors have been discussed with reference to further reference numbers, see below. The invention is not limited to a particular type of sensor as long as the sensor is suitable for directly or indirectly sensing at least one operational characteristic of the ship 2. Examples of the at least one sensor and the at least one operational characteristic of the ship 2 are discussed below.

The operational characteristic of the ship 2 may be an operational characteristic of the ship 2 that changes with the propulsive power output applied to the propeller shaft 6.

The control unit 16 comprises at least one calculation unit which may take the form of substantially any suitable type of processor circuit or microcomputer, e.g. a circuit for digital signal processing (digital signal processor, DSP), a Central Processing Unit (CPU), a processing unit, a processing circuit, a processor, an Application Specific Integrated Circuit (ASIC), a microprocessor, or other processing logic that may interpret and execute instructions. The herein utilised expression "calculation unit" may represent a processing circuitry comprising a plurality of processing circuits, such as, e.g., any, some or all of the ones mentioned above. The control unit 16 comprises a memory unit. The calculation unit is connected to the memory unit, which provides the calculation unit with, for example, the stored programme code and/or stored data which the calculation unit needs to enable it to do calculations. Such data may relate to operational parameters of the ship 2, e.g. acceleration values, and/or acceleration-force correlation, and/or propeller slip, and/or propeller shaft torque, etc. Such data may alternatively or additionally relate to the ICE 14, e.g. fuel consumption, and/or rotational speed, and/or power output, and/or to turbocharger rotational speed, turbocharger pressure/s, and/or cylinder pressure, and/or ICE output shaft torque.

The calculation unit is also adapted to storing partial or final results of calculations, and/or measured and/or determined parameters in the memory unit, e.g. in tables to be use in calculations or for determining values. The memory unit may comprise a physical device utilised to store data or programs, i.e., sequences of instructions, on a temporary or permanent basis. According to some embodiments, the memory unit may comprise integrated circuits comprising silicon-based transistors. The memory unit may comprise e.g. a memory card, a flash memory, a USB memory, a hard disc, or another similar volatile or non-volatile storage unit for storing data such as e.g. ROM (Read-Only Memory), PROM (Programmable Read-Only Memory), EPROM (Erasable PROM), EEPROM (Electrically Erasable PROM), etc. in different embodiments.

The control unit 16 is further provided with devices for receiving and/or sending input and output signals, respectively. These input and output signals may comprise waveforms, pulses or other attributes which the input signal receiving devices can detect as information and which can be converted to signals processable by the calculation unit.

For instance, the at least one sensor 18 for sensing at least one operational characteristic of the ship 2, provides such signals which are received by the input signal receiving devices. These signals are then supplied to the calculation unit. A user interface 20 may send signals to the input signal receiving devices.

The output signal sending devices are arranged to convert calculation results from the calculation unit to output signals for conveying to the component or components for which the signals are intended. Output signal sending device may send control signals for controlling e.g. the propulsive power source 4, and/or the operation of the ICE 14, and optionally to a controllable pitch propeller 8. The output signal sending devices may send signals representing data and/or information relating to the operation of the propulsive power source 4 and/or the ICE 14 to the user interface 20.

Each of the connections to the respective devices for receiving and sending input and output signals may take the form of one or more forms selected from among a cable, a data bus, e.g. a CAN (controller area network) bus, a MOST (media orientated systems transport) bus or some other bus configuration, or a wireless connection.

Thus, the control arrangement 12 is configured, under the control of the control unit 16, to control at least part of the propulsive power source 4 and in particular, the ICE 14, such as the rotational speed and/or power output of the ICE 14.

The control arrangement 12 is configured to:

Apply a control signal to the propulsive power source 4 for controlling the power output applied to the propeller shaft 6 by the propulsive power source 4, wherein the control signal is variable within an interval limited by an upper control limit value and a lower control limit value.

Determine a current value of an operational parameter of the ship 2 utilising the at least one sensor 18.

Compare the current value of the operational parameter with a first parameter limit value. If the current value of the operational parameter reaches the first parameter limit value, the control arrangement 12 is configured to:

Reduce the upper control limit value.

The propulsive power source 4 has a power window within which the propulsive power source 4 may be operated. The control signal controls the propulsive power source 4 within the power window. The power window is defined by the interval limited by the upper control limit value and a lower control limit value. The upper and lower power limit values are set in the control arrangement 12, e.g. they may be set in the control unit 16. The control arrangement 12 is configured to maintain the power output of the propulsive power source 4 applied to the propeller shaft 6 within the power window.

Since the upper control limit value can be reduced, as mentioned above, the size of the interval and accordingly, the size of the power window, is adaptable. Reduction of the upper control limit value may be performed in response to a change in the operational characteristic of the ship 2 as reflected in the comparison of the current value of the operational parameter with the first parameter limit value.

Accordingly, since the control arrangement 12 of the system 10 for controlling the propulsive power output applied to the propeller shaft 6 of the ship 2 is configured to reduce the upper control limit value, if the current value of the operational parameter of the ship 2 reaches the first parameter limit value, the system 10 for controlling the propulsive power output takes account of the operating conditions of the ship for preventing the propulsive power source from applying a too high power output to the propeller shaft 6, which would be unfavourable for the ship 2.

The operational parameter of the ship 2 may be determined at least partially based on the operational characteristic of the ship 2 as sensed by the at least one sensor 18.

According to embodiments of the system 10, the control arrangement 12 may be optionally configured to:

- determine a current value of a further operational parameter of the ship 2 utilising the at least one sensor 18. The control arrangement 12 may be configured to:
- compare the current value of the operational parameter or a current value of the further operational parameter with a second parameter limit value.

If the current value of the operational parameter or the current value of the further operational parameter reaches the second parameter limit value, the control arrangement 12 may be configured to:

- increase the lower control limit value. In this manner, the system 10 for controlling the propulsive power output takes account of the operating conditions of the ship 2 for preventing the propulsive power source 4 from applying a too low power output to the propeller shaft 6.

Since the lower control limit value can be increased, as mentioned above, the size of the interval and accordingly, the size of the power window, is adaptable. Increase of the lower control limit value may be performed in response to a change in the operational characteristic of the ship 2 as reflected in the comparison of the current value of the operational parameter or the current value of the further operational parameter with the second parameter limit.

Accordingly, since the control arrangement 12 of the system 10 for controlling the propulsive power output applied to the propeller shaft 6 of the ship 2 is configured to increase the lower control limit value, if the current value of the operational parameter of the ship 2 reaches the second parameter limit value, the system 10 for controlling the propulsive power output takes account of the operating conditions of the ship for preventing the propulsive power source from applying a too low power output to the propeller shaft 6, which could be unfavourable for the ship 2.

As understood from the discussion above, the second parameter limit value may relate either to the same operational parameter as the first parameter limit value or to a different operational parameter, i.e. the further operational parameter.

To clarify, the upper control limit value causes the propulsive power source 4 to produce high propulsive power output applied to the propeller shaft 6, and the lower control limit value causes the propulsive power source 4 to produce low propulsive power output applied to the propeller shaft 6. Accordingly, under ideal operating conditions of the ship 2, the upper power limit may correspond to a maximum power output of the propulsive power source 4 applied to the propeller shaft 6, and the lower power limit may correspond to a minimum power output of the propulsive power source 4 applied to the propeller shaft 6.

During operation of the propulsive power source 4, it is controlled based on a setpoint within the available power window of the propulsive power source 4. The setpoint is chosen by personnel or an autopilot system of the ship 2, e.g. via the user interface 20, and e.g. based on how the ship 2 is to be propelled under its current operation conditions.

The upper control limit value forms an upper threshold for the setpoint and accordingly, for the propulsive power output from the propulsive power source 4 to the propeller shaft 6 of the ship 2. Initially, the upper control limit value may be a value based on e.g. nautical requirements on the ship 2, and/or a desired maximum ship speed, and/or upper power limit related aspects of the propulsive power source 4, and/or propeller 8 limitations, and/or minimising potential ship 2 and/or cargo damage. In accordance with the invention, the upper control limit value may be adjusted based on the current value of the operational parameter of the ship 2.

The first parameter limit value forms a threshold for the operational parameter. At this threshold, the ship 2 may begin, or may be close to beginning, to exhibit operating drawbacks because of a too high power output of the propulsive power source 4 as determined in the comparison of the current value of the operational parameter of the ship 2 with the first parameter limit value.

The lower control limit value forms a lower threshold for the setpoint and accordingly, for the propulsive power output from the propulsive power source 4 to the propeller shaft 6 of the ship 2. Initially, the lower control limit value may be a value based on e.g. nautical requirements on the ship 2, and/or a desired minimum ship speed, and/or a steerageway of the ship 2, and/or an idle speed of the ICE 14. In accordance with embodiments, the lower control limit value may be adjusted based the current value of the operational parameter or the current value of the further operational parameter.

The second parameter limit value forms a threshold for the relevant operational parameter. At this threshold, the ship 2 may begin, or may be close to beginning, to exhibit operating drawbacks because of a too low power output of the propulsive power source 4 as determined in the comparison of the current value of the operational or further operational parameter of the ship 2 with the second parameter limit value.

Mentioned purely as an example, the increase of the lower control limit value may be 0.5%, or 1.0%, or even larger, such as 2-10%, depending on e.g. the maximum power output of the propulsive power source 4. As a general rule, the higher the maximum power output, the lower the increase of the lower control limit value may be required in order to achieve a noticeable change in the operational behaviour of the ship 2.

Mentioned purely as an example, the reduction of the upper control limit value may be 0.5%, or 1.0%, or even larger, such as 2-10%, depending on e.g. the maximum power output of the propulsive power source 4, the higher the maximum power output, the lower the reduction of the upper control limit value may be required in order to achieve a noticeable change in the operational behaviour of the ship 2.

The user interface 20 may be connected to the control unit 16. The user interface 20 may be arranged on the bridge of the ship 2. Via the user interface 20, user controllable aspects of the control arrangement 12 may be controlled by personnel. For instance, the user interface 20 may comprise a manually controllable device or autopilot system for setting a setpoint around which propulsion of the ship 2 is controlled. Via the user interface 20, information from/about the control arrangement 12 may be presented to personnel aboard the ship 2. For instance, information about the size of the interval (the power window) and/or the upper control limit value and optionally the lower control limit value may be presented.

Accordingly, according to some embodiments, the control arrangement 12 may comprise visual and/or audible indicating means, e.g. in the form of the user interface 20. If the current value of the operational parameter reaches the first parameter limit value, the control arrangement 12 may be configured to:

indicate via the visual and/or audible indicating means the reduction of the upper control limit value.

According to some embodiments, if the current value of the operational parameter or the current value of the further operational parameter reaches the second parameter limit value, the control arrangement 12 may be configured to:

indicate via the visual and/or audible indicating means the increase of the lower control limit value.

According to embodiments, the at least one sensor 18 for sensing at least one operational characteristic of the ship 2 may be configured for sensing a characteristic related to ambient conditions affecting the ship 2. In this manner, the characteristic related to ambient conditions affecting the ship 2 may be utilised for determining the current value of the operational parameter of the ship 2 and/or the further operational parameter of the ship 2 and for comparing the current value of the operational parameter and/or the further operational parameter with the first parameter limit value and/or the second parameter limit value. Accordingly, in these embodiments, the operational parameter and/or the further operational parameter, and the first parameter limit value and/or the second parameter limit value may relate to ambient conditions affecting the ship 2.

Ambient conditions affecting the ship 2 may also be referred to as sea load. The ambient conditions affecting the ship 2 may comprise e.g. one or more of waves, wind, and sea depth.

In accordance with these embodiments, the at least one sensor 18 may comprise at least one of an inclination sensor 22, an anemometer 24, an accelerometer 26, and a depth sounding sensor 28. Accordingly:

One or more inclination sensors 22 may measure e.g. the angle of list of the ship, i.e. the degree to which the ship 2 tilts to either port or starboard. Thus, the operational parameter may relate to the angle of list of the ship 2 and the first parameter limit value may relate to a maximum angle of list of the ship 2. An angle of list of the ship 2 exceeding the maximum angle of list of the ship 2 may thus, lead to reduction of the upper control limit value.

An anemometer 24 may measure wind strength and/or direction. Thus, the operational parameter may relate to wind strength and/or wind direction and the first parameter limit value may relate to a limit wind strength, and optionally in combination with particular wind directions. A high wind strength and/or an unfavourable wind direction, such as strong head wind, or strong side wind may cause the first parameter limit to be reached and thus, reduction of the upper control limit value.

One or more accelerometers 26 may measure acceleration in one, two or three directions of selected portions of a hull of the ship 2. Thus, the operational parameter and the first parameter limit value may relate to accelerations and/or forces acting on the ship 2 and/or its crew and/or its cargo. Accelerations and/or forces exceeding corresponding limit values may thus, lead to reduction of the upper control limit value.

A depth sounding sensor 28, such as e.g. a sonar, may measure sea depth. Thus, the operational parameter and the first parameter limit value may relate to a minimum sea depth. In order to reduce shallow water effects, sea depths at the minimum sea depth may thus, lead to a reduction of the upper control limit value.

Ideal weather conditions as detected by the at least one sensor 18 may lead to an increase of the lower control limit value. For instance, in certain instances the lower control limit value may be set to relate to average ambient conditions affecting the ship 2. If ambient conditions are better than average, as determined in the comparison of the current value of the operational parameter or the current value of the further operational parameter with the second parameter limit value, the lower control limit value may be increased.

See further below with reference to FIG. 4 and the method 100.

According to embodiments, the at least one sensor 18 for sensing at least one operational characteristic of the ship 2 may be configured for sensing a characteristic related to a load affecting to the propeller shaft 6. In this manner, the characteristic related to load affecting the propeller shaft 6 of the ship 2 may be utilised for determining the current value of the operational parameter of the ship 2 and/or the further operational parameter of the ship 2 and for comparing the current value of the operational parameter and/or the further operational parameter with the first parameter limit value and/or the second parameter limit value. Accordingly, in these embodiments, the operational parameter and/or the further operational parameter, and the first parameter limit value and/or the second parameter limit value may relate to load affecting the propeller shaft 6 of the ship 2.

For instance, the load affecting the propeller shaft 6 may be reflected by the work performed by the propeller 8 as the propeller 8 is driven to propel the ship 2. Accordingly, e.g. the torque transmitted via the propeller shaft 6 between the propeller 8 and the propulsive power source 4 may represent the load affecting the propeller shaft 6. The load affecting the propeller shaft 6 may be reflected by changes in rotational speed and/or a difference between a current and an expected rotational speed. The load affecting the propeller shaft 6 may be reflected by a difference between a current and an expected speed of the ship 2.

According to embodiments, the at least one sensor 18 may comprise at least one of a torque meter 30, a strain gauge 32, a rotational speed sensor 34 of the propeller shaft 6 or the ICE 14, and a speed measuring device 35. Accordingly:

A torque meter 30 may measure a torque applied to the propeller shaft 6. The measured torque may represent the load affecting the propeller shaft 6. Thus, the operational parameter and/or the further operational parameter may relate to the torque or changes in torque applied to the propeller shaft 6. Accordingly, the first and/or second parameter limit value may relate to e.g., torque or to changes in torque, such as an absolute value of a derivative of the torque applied to the propeller shaft 6 or an amplitude of the changes in torque applied to the propeller shaft 6 over a time period.

A strain gauge 32 may measure torsional strain of the propeller shaft 6. Torsional strain data may be utilised for determining the torque applied to the propeller shaft 6. Such determined torque may be utilised in the above manner. Alternatively, torsional strain data may represent the load affecting the propeller shaft 6. Thus, the operational parameter and/or the further operational parameter may relate to the torsional strain or changes in torsional strain applied to the propeller shaft 6. Accordingly, the first and/or second parameter limit value may relate to e.g., a torsional strain or to in torsional strain, such as an absolute value of a derivative of the torsional strain applied to the propeller shaft 6 or an amplitude of the changes of the torsional strain applied to the propeller shaft 6 over a time period.

A rotational speed sensor 34 may measure the rotational speed of the propeller shaft 6 and/or of the ICE 14. Changes in rotational speed may indicate changes in the load affecting the propeller shaft 6. A difference between a current rotational speed and an expected rotational speed may indicate a difference between a current load affecting the propeller shaft 6 and an expected load affecting the propeller shaft 6. Thus, the operational parameter and/or the further operational parameter may relate to the rotational speed of the propeller shaft 6 or of the ICE 14. In the latter case the rotational speed of the ICE 14 correlates with that of the propeller shaft 6. Accordingly, the first and/or the second parameter limit value may relate to changes in rotational speed, such as an absolute value of a derivative of the rotational speed or an amplitude of the changes of the rotational speed over a time period. The first and/or the second parameter limit value may relate to a difference between a current rotational speed and an expected rotational speed.

A speed measuring device 35 of the ship 2 may measure the speed of the ship 2. The speed measuring device 35 may for instance be a measuring device utilising GPS data for determining the speed of the ship 2. A difference between a current speed and an expected speed of the ship 2 may indicate a difference between a current load affecting the propeller shaft 6 and an expected load affecting the propeller shaft 6. Thus, the operational parameter and/or the further operational parameter may relate to the speed of the ship 2. Accordingly, the first and/or the second parameter limit value may relate to a negative and/or positive difference between a current speed and an expected speed of the ship 2.

See further below with reference to FIG. 4 and the method 100.

According to embodiments, the at least one sensor 18 for sensing at least one operational characteristic of the ship 2 may be configured for sensing a characteristic related to a cargo load affecting cargo 40 aboard the ship 2. In this manner, the characteristic related to the cargo load affecting the cargo 40 aboard the ship 2 may be utilised for determining the current value of the operational parameter and/or the further operational parameter of the ship and for comparing the current value of the operational parameter with the first parameter limit value and/or the current value of the operational parameter or the current value of the further operational parameter with the second parameter limit value. Accordingly, in these embodiments, the first parameter limit value and/or the second parameter value may relate to a cargo load affecting the cargo 40.

According to embodiments, the at least one sensor 18 may comprise at least one of a strain gauge 42 and an accelerometer 44. Accordingly:

A strain gauge 42 may measure strain affecting e.g. a cargo container or cargo securing equipment such as a shackle. Strain data may represent the cargo load affecting the cargo 40 aboard the ship 2. Thus, the operational parameter may relate to the strain affecting the cargo 40. Accordingly, the first parameter limit value may relate to e.g., a maximum permissible strain affecting the cargo 40.

One or more accelerometers 44 may measure acceleration in one, two or three directions of the cargo 40. Thus, the operational parameter and the first parameter limit value may relate to accelerations and/or forces acting on the cargo 40. Accelerations and/or forces exceeding corresponding limit values may thus, lead to reduction of the upper control limit value.

One or more vibration sensors (not shown) may measure vibrations affecting the cargo 40. The operational parameter and/or the further operational parameter and the first parameter limit value and/or the second parameter limit value may relate to vibrations affecting the cargo 40. Vibrations exceeding corresponding limit values may thus lead to reduction of the upper control limit value and/or increase of the lower control limit value.

See further below with reference to FIG. 4 and the method 100.

The different examples of the at least one operational characteristics of the ship 2 discussed above and below may overlap. That is, at least some of the characteristics related to ambient conditions affecting the ship 2, the characteristics related to the load affecting to the propeller shaft 6, the characteristics related to the cargo load affecting the cargo 40 aboard the ship 2, and/or the parameters of the turbocharger 52 and/or of the cylinder arrangement 50, may form different indicators for indicating one and the same cause of a particular state or condition of the ship 2. For instance, rough ambient conditions caused by e.g. strong wind may also cause changes in the load affecting the propeller shaft 6 as well as a high cargo load affecting the cargo 40.

Accordingly, measurements from the different sensors 18, related to the above mentioned ambient condition characteristics, propeller shaft load characteristics, cargo load characteristics, and turbocharger and cylinder arrangement parameters, may be combined for determining the operational parameter and/or the further operational parameter of the ship 2.

The above and below mentioned ambient condition characteristics, propeller shaft load characteristics, cargo load characteristics, and turbocharger and cylinder arrangement parameters all affect the ship 2 and as such, are, or relate to, operational characteristics of the ship 2. As mentioned above, the operational characteristic of the ship 2 may be an operational characteristic of the ship 2 that changes with the propulsive power output applied to the propeller shaft 6. The manner in which each of; the ambient condition characteristics, propeller shaft load characteristics, cargo load characteristics, and turbocharger and cylinder arrangement parameters affects the ship 2 changes as the propulsive power output applied to the propeller shaft 6 changes.

According to embodiments of the system 10, the control arrangement 12 may be configured to:

determine a subsequent current value of the operational parameter of the ship 2 utilising the at least one sensor 18, and compare the subsequent current value of the operational parameter with the first parameter limit value and/or a third parameter limit value If the subsequent current value of the operational parameter reaches the first parameter limit value, the control arrangement 12 may be configured to:

further reduce the upper control limit value, or if the subsequent current value of the operational parameter stays clear of the third parameter limit value, the control arrangement 12 may be configured to:

increase the upper control limit value.

In this manner, the upper control limit value may be adapted to changing operating conditions of the ship 2. That is, if the operating conditions of the ship 2 have changed, the subsequent current value of the operational parameter of the ship 2 may represent such changed operating conditions. If the subsequent current value of the operational parameter has changed to such a degree that the first parameter limit value has again been reached, the upper control limit value may be further reduced. If on the other hand, the subsequent current value of the operational parameter has changed to such a degree that the third parameter limit value is not reach, the upper control limit value may be increased. Accordingly, the size of the power window may be continuously or intermittently adapted to current operating conditions of the ship.

Again, the first parameter limit value may represent a value of the operational parameter of the ship 2, which when reached, indicates that the propulsive power source 4 is operated at a too high output level. In these embodiments, the propulsive power source 4 is operated at a too high output level for the changed operating conditions as represented by the subsequent current value of the operational parameter. Thus, in accordance with these embodiments, a further reduction of the upper control limit value may be provided.

In these embodiments, the third parameter limit value may represent a value of the operational parameter of the ship 2, which if not reached, indicates that the upper control limit value is set lower than the changed operating conditions permit, as represented by the subsequent current value of the operational parameter of the ship 2. Thus, in accordance with these embodiments, the upper control limit value may be increased.

Accordingly, in these embodiments, the third parameter limit value is a lower value than the first parameter limit value.

See further below with reference to FIG. 4 and the method 100.

According to embodiments of the system 10, the control arrangement 12 may be configured to:

determine a subsequent current value of the operational parameter of the ship 2 or a subsequent current value of the further operational parameter of the ship 2, and compare the subsequent current value of the operational parameter or the subsequent current value of the further operational parameter with the second parameter limit value and/or a fourth parameter limit value. If the subsequent current value of the operational parameter or the subsequent current value of the further operational parameter reaches the second parameter limit value, the control arrangement 12 may be configured to:

further increase the lower control limit value, or if the subsequent current value of the operational parameter or the subsequent current value of the further operational parameter stays clear of the fourth parameter limit value, the control arrangement 12 may be configured to:

reduce the lower control limit value.

In this manner, the lower control limit value may be adapted to changing operating conditions of the ship 2. If the operating conditions of the ship 2 have changed, the subsequent current value of the operational parameter of the ship 2, or the subsequent current value of the further operational parameter, may represent such changed operating conditions. If the subsequent current value of the operational parameter or the subsequent current value of the further operational parameter has changed to such a degree that the second parameter limit value has again been reached, the lower control limit value may be further increased. If on the other hand, the subsequent current value of the operational parameter or the subsequent current value of the further operational parameter has changed to such a degree that the third parameter limit value is not reach, the lower control limit value may be increased. Accordingly, the size of the power window may be continuously or intermittently adapted to current operating conditions of the ship.

Again, the second parameter limit value may represent a value of the operational parameter or of the further operational parameter of the ship 2, which when reached, indicates that the propulsive power source 4 is operated at a too low output level. In these embodiments, the propulsive power source 4 is operated at a too low output level for the changed operating conditions as represented by the subsequent current value of the operational parameter or of the subsequent current value of the further operational parameter. Thus, in accordance with these embodiments, a further increase of the lower control limit value may be provided.

In these embodiments, the fourth parameter limit value may represent a value of the operational parameter or of the further operational parameter of the ship 2, which if not reached, indicates that the lower control limit value is set higher than the changed operating conditions permit, as represented by the subsequent current value of the operational parameter of the ship 2 or of the subsequent current value of the further operational parameter of the ship 2. Thus, in accordance with these embodiments, the upper control limit value may be increased.

Accordingly, in these embodiments, the fourth parameter limit value is a higher value than the second parameter limit value.

See further below with reference to FIG. 4 and the method 100.

FIG. 3 schematically illustrates a cross section through the ICE 14 shown in FIG. 2. In the following reference is made to the ICE 14. The same description may apply to any further ICE comprised in the propulsive power source.

The ICE 14 comprises at least one cylinder arrangement 50 and a turbocharger 52. The cylinder arrangement 50 comprises a combustion chamber 54, a cylinder bore 56, a piston 58 configured to reciprocate in the cylinder bore 56, a gas inlet 60 connected to the combustion chamber 54, and a gas outlet 62 connected to the combustion chamber 54. The gas outlet 62 is connected to a turbine 64 of the turbocharger 52 and the gas inlet 60 is connected to a compressor 66 of the turbocharger 52.

A connecting rod 53 connects the piston 58 to a crankshaft 55 of the ICE 14. One or more intake valves 57 are arranged for controlling gas flow through the gas inlet 32. One or more exhaust valves 59 are arranged for controlling gas flow through the gas outlet 34. The intake and exhaust valves 57, 59 are controlled by one common camshaft, or by one camshaft each (not shown). Fuel is injected into the combustion chamber 54 via a fuel injector 61.

In a known manner, the turbocharger 52 comprises the turbine 64, which drives the compressor 66 via a common shaft (not shown). The turbine 64 is driven by exhaust gas ejected from the combustion chamber 54. The compressor 66 compresses fresh gas, typically air, for intake into the combustion chamber 54.

Typically, the ICE 14 may comprise any number of cylinder arrangements 50, such as e.g. 4-20 cylinder arrangements, i.e. the ICE 14 may be a 4-20 cylinder ICE.

The ICE 14 may comprise more than one turbocharger 52. For instance, the ICE 14 may comprise two turbochargers, each being connected to half of the cylinder arrangements 50 of the ICE 14, or the ICE 14 may comprise one turbocharger 52 for each cylinder arrangement 50, or any other suitable number of turbochargers 52.

A rotational speed of the turbocharger 52 relates to the rotational speed of the turbine 64, the compressor 66, and the common shaft connecting them.

The ICE 14 has a recommended lower power output level and a recommended upper power output level. The recommended lower and upper power output levels define a power range, within which the ICE 14 may be operated efficiently, and/or reliably, and/or in an environmentally friendly manner, and/or without harming the ICE 14.

The control unit 16 of the control arrangement is schematically illustrated in FIG. 3.

The at least one sensor 18 for sensing at least one operational characteristic of the ship may comprise one or more sensors 18, 68, 70 for sensing at least one operational parameter of the ICE 14. The at least one sensor 18, 68, 70 for sensing at least one operational parameter of the ICE 14 may be configured for sensing a parameter of the turbocharger 52, and/or of the cylinder arrangement 50.

It may be noted that the at least one sensor 18, 22-35, 42, 44, 68, 70 is only schematically indicated in FIGS. 2 and 3. Accordingly, the actual position of the at least one sensor 18, 22-35, 42, 44, 68, 70 depends on the type of sensor and the parameter to be sensed and/or measured.

In the following, reference is made to FIGS. 2 and 3 for discussing embodiments wherein the at least one sensor 18 for sensing at least one operational characteristic of the ship comprises one or more sensors 68, 70 for sensing at least one operational parameter of the ICE 14.

Thus, according to embodiments, of the system 10, the propulsive power source 4 may comprise an internal combustion engine 14 connected to the propeller shaft 6. The internal combustion engine 14 may comprise at least one cylinder arrangement 50 and a turbocharger 5. The at least one cylinder arrangement 50 comprises a combustion chamber 54, a cylinder bore 56, a piston 58 configured to reciprocate in the cylinder bore 56, a gas inlet 60 connected to the combustion chamber 54, and a gas outlet 62 connected to the combustion chamber 54. The gas outlet 62 is connected to a turbine 64 of the turbocharger 52 and the gas inlet 60 is connected to a compressor 66 of the turbocharger 52. The at least one sensor 18 for sensing at least one operational characteristic of the ship 2 may be configured for sensing a parameter of the turbocharger 52, and/or of the at least one cylinder arrangement 50.

According to embodiments, the at least one sensor 18 may comprise:

- a rotational speed sensor of the turbocharger 52,
- pressure sensor 68 of the turbocharger 52,
- temperature sensor 68 of the turbocharger 52,
- temperature sensor 70 of the cylinder arrangement 50,
- a pressure sensor 70 of the combustion chamber 50. In this manner, the operational parameter and/or the further operational parameter of the ship may be related to a parameter of the ICE 14 and the upper and/or lower control limit values may be adapted to a current operation of the ICE 14. As such, the above mentioned sensors are known and will not be explained further herein. The at least one sensor 18, 68, 70 may be configured to continuously or intermittently sense and/or measure at least one operational parameter of the ICE 14. The control unit 16 is configured to receive sensed and/or measured data related to the operational parameter from the at least one sensor 18, 68, 70.

In the following discussion, some non-liming examples of how the parameters sensed by these sensors 18, 68, 70 may relate to operating conditions of the ship 2 and how the control unit 16 may be configured to may change the upper and/or lower control limit values in response to a current value of the operational parameter and/or a current value of the further operational parameter reaching the first or second parameter limit value.

According to some embodiments, the operational parameter and/or the further operational parameter may relate to one of:

- a rotational speed of the turbocharger 52,
- a temperature at the inlet at the turbine 64 of the turbocharger 52,
- a temperature at an outlet at the turbine 64 of the turbocharger 52,
- a pressure at the outlet at the compressor 66 of the turbocharger 52. In this manner, the operational parameter and/or the further operational parameter may relate to the turbocharger 52.

A high rotational speed of the turbocharger 52 may indicate that the ICE 14 is operating at its upper power output level. The first parameter limit value may represent an upper rotational speed threshold of the turbocharger 52. If the current value of the operational parameter, as represented by the current rotational speed of the turbocharger 52, reaches the first parameter limit value, the upper control limit value may be reduced.

A low rotational speed of the turbocharger 52 may indicate that the ICE 14 is operating at its lower power output level. The second parameter limit value may represent a lower rotational speed threshold of the turbocharger 52. If the current value of the operational parameter, as represented by the current rotational speed of the turbocharger 52, reaches the second parameter limit value, the lower control limit value may be increased.

A high temperature at the inlet at the turbine 64 of the turbocharger 52 may indicate that the ICE 14 is operating at its upper power output level. A high temperature at an outlet at the turbine 64 of the turbocharger 52 may indicate that the ICE 14 is operating at its lower power output level. The first and second parameter limit values may represent respective upper temperature thresholds at the inlet and the outlet of the turbine 64 of the turbocharger 52. If a relevant parameter limit value is reached, the upper control limit value may be reduced or the lower control limit value may be increased.

A low pressure at the outlet at the compressor 66 of the turbocharger 52 may indicate that the ICE 14 is operating at its lower power output level. Thus, the second parameter limit value may represent a lower pressure threshold at the outlet at the compressor 66 of the turbocharger 52. If the current value of the operational parameter and/or the current value of further operational parameter, as represented by the current pressure at the outlet of the compressor of the turbocharger 52, reaches the second parameter limit value, the lower control limit value may be increased.

Purely mentioned as an example, an ICE 14 in the form of a two-stroke diesel engine may comprise electrically-driven auxiliary blowers configured for providing charge air to the cylinders at low engine speeds. Namely, at low engine speeds the turbocharger cannot provide enough air for charging the cylinders. Operation of the propulsive power source 4 close to the lower power limit value may cause the ICE 14 to operate at such low speed that the auxiliary blowers are automatically started. This in turn, will increase the power output of the ICE 14 which produces a higher charge air pressure by the compressor of the turbocharger 52 and causes the auxiliary blower to shut down. In order to avoid such a situation, or to avoid starting the auxiliary blowers at all, the operational parameter or the further operational parameter may be the pressure at the outlet of compressor 66, and the second parameter limit value may suitably be set at a pressure level just before the auxiliary blowers are started.

Conversely, a high pressure at the outlet at the compressor 66 of the turbocharger 52 may indicate that the ICE 14 is operating at its upper power output level.

According to some embodiments, the operational parameter and/or the further operational parameter may relate to one of:

- a temperature of the cylinder arrangement, or
- a pressure within the combustion chamber. In this manner, the operational parameter and/or the further operational parameter may relate to the cylinder arrangement 50.

A high temperature of the cylinder arrangement 50 and/or a high pressure within the combustion chamber 54 may indicate that the ICE 14 is operating at its upper power output level. The first and second parameter limit values may represent respective upper temperature and pressure thresholds of the cylinder arrangement 50. If a relevant parameter limit value is reached, the upper control limit value may be reduced.

Alternatively, a temperature sensor for sensing engine coolant and/or engine lubricant temperature may be utilised for determining a current value of a temperature of the ICE 14. Such a current value of the temperature of the ICE 14 may be utilised in a similar manner as discussed above.

According to some embodiments, the operational parameter and/or the further operational parameter may relate to one of:

- an absolute value of a derivative of the rotational speed of the turbocharger 52,
- a variation of an amplitude of the rotational speed of the turbocharger 52,
- an absolute value of a derivative of the pressure at the outlet at the compressor 66 of the turbocharger 52,
- a variation of an amplitude of the pressure at the outlet at the compressor 66 of the turbocharger 52, A high absolute value of the derivative of the rotational speed of the turbocharger 52, may indicate that the ICE 14 is operating close to a dynamic upper power output limit, causing pulsating rotation of the turbocharger 52. Dynamic operation of the ICE 14 may be caused e.g. by particular sea conditions, such as the ship traveling through high waves. A high absolute value of the derivative of the rotational speed of the turbocharger 52 indicates quick rotational speed changes of the turbocharger 52. Such quick changes indicate pulsating exhaust gas flow, which in turn may cause stalling of the turbine 64 of the turbocharger 52. A reduction of the power output of the ICE 14 will cause less exhaust gas to be produced in the ICE 14, which in turn reduces the turbocharger rotational speed and pressure on the outlet side of the compressor 66.

Thus, rotational speed changes of the turbocharger 52 are reduced. The first parameter limit value may be selected such that stalling of the turbine 64 is prevented during rotational speed changes of the turbocharger 52. If the current value of the operational parameter, as represented by the current absolute value of the derivative of the rotational speed of the turbocharger 52, reaches the first parameter limit value, the upper control limit value may be reduced.

The variation of the amplitude of the rotational speed of the turbocharger 52 relates to the difference between the maximum rotational speed and the minimum rotational speed of the turbocharger 52 during pulsating rotation of the turbocharger 52. Pulsating rotation of the turbocharger 52 may be caused e.g. by particular sea conditions, such as the ship traveling through high waves.

A high variation of the amplitude of the rotational speed of the turbocharger 52 may indicate that the ICE 14 is operating at close to a dynamic upper power output limit, causing pulsating rotation of the turbocharger 52. Dynamic operation of the ICE 14 may be caused e.g. by particular sea conditions, such as the ship traveling through high waves. A high variation of the amplitude of the rotational speed of the turbocharger 52 indicates large rotational speed variations of the turbocharger 52. Such large variations indicate pulsating exhaust gas flow, which in turn may cause stalling of the turbine 64 of the turbocharger 52. A reduction of the power output of the ICE 14 will cause less exhaust gas to be produced in the ICE 14, which in turn reduces the turbocharger rotational speed and pressure on the outlet side of the compressor 66. Thus, rotational speed changes of the turbocharger 52 are reduced. The first parameter limit value may be selected such that stalling of the turbine 64 is prevented during rotational speed changes of the turbocharger 52. If the current value of the operational parameter, as represented by the current absolute value of the derivative of the rotational speed of the turbocharger 52, reaches the first parameter limit value, the upper control limit value may be reduced.

A high absolute value of a derivative of the pressure at the outlet at the compressor 66 of the turbocharger 52, may indicate that the ICE 14 is operating close to a dynamic upper power output limit, causing pulsating rotation of the turbocharger 52. Dynamic operation of the ICE 14 may be caused e.g. by particular sea conditions, such as the ship traveling through high waves. A high absolute value of the derivative of the pressure at the outlet at the compressor 66 of the turbocharger 52 indicates quick rotational speed changes of the turbocharger 52. Such quick changes indicate pulsating exhaust gas flow, which in turn may cause stalling of the turbine 64 of the turbocharger 52. A reduction of the power output of the ICE 14 will cause less exhaust gas to be produced in the ICE 14, which in turn reduces the turbocharger rotational speed and pressure on the outlet side of the compressor 6648. Thus, pressure changes at the outlet at the compressor 66 of the turbocharger 52 are reduced. The first parameter limit value may be selected such that stalling of the turbine 64 is prevented during rotational speed changes of the turbocharger 52. If the current value of the operational parameter, as represented by the current absolute value of the derivative of the pressure at the outlet at the compressor 66 of the turbocharger 52, reaches the first parameter limit value, the upper control limit value may be reduced.

The variation of the amplitude of the pressure at the outlet at the compressor 66 of the turbocharger 52 relates to the difference between the maximum pressure and the minimum pressure at the outlet at the compressor 66 of the turbocharger 52 during pulsating rotation of the turbocharger 52. Pulsating rotation of the turbocharger 52 may be caused e.g. by particular sea conditions, such as the ship traveling through high waves.

A high variation of the amplitude of the pressure at the outlet at the compressor 66 of the turbocharger 52 may indicate that the ICE 14 is operating close to a dynamic upper power output limit, causing pulsating rotation of the turbocharger 52. Dynamic operation of the ICE 14 may be caused e.g. by particular sea conditions, such as the ship traveling through high waves. A high variation of the amplitude of the pressure at the outlet at the compressor 66 of the turbocharger 52 indicates large pressure variations at the outlet at the compressor 66 of the turbocharger 52. Such large variations indicate pulsating exhaust gas flow, which in turn may cause stalling of the turbine 64 of the turbocharger 52. A reduction of the power output of the ICE 14 will cause less exhaust gas to be produced in the ICE 14, which in turn reduces the turbocharger rotational speed and pressure on the outlet side of the compressor 66. Thus, rotational speed changes of the turbocharger 52 are reduced. The first parameter limit value may be selected such that stalling of the turbine 64 is prevented during pressure changes of the turbocharger 52. If the current value of the operational parameter, as represented by the current variation of the amplitude of the pressure at the outlet at the compressor 66 of the turbocharger 52, reaches the first parameter limit value, the upper control limit value may be reduced.

For a new or serviced ICE 14 and under ordinary operating conditions aboard the ship 2, the upper control limit value will be reached before the first parameter limit value is reached. However, under particular operating conditions of the ship 2, such as e.g. under particular sea and/or weather conditions, and/or under particular operating conditions of the ICE 14, such as e.g. conditions related to a maintenance status of the ICE 14, and/or fuel energy content, the first parameter limit value may be reached before the upper control limit value is reached. This condition would then lead to a reduction of the upper control limit value.

For a new or serviced ICE 14 and under ordinary operating conditions of the ship 2, the lower control limit value related commonly will be reached before the second parameter limit value is reached. However, under particular operating conditions of the ship, such as e.g. under particular sea and/or weather conditions, and/or under particular operating conditions of the ICE, such as e.g. conditions related to a maintenance status of the ICE 14, and/or fuel energy content, the second parameter limit value may be reached before the lower control limit value is reached. This condition would then lead to an increase of the lower control limit value.

The above discussed operational parameters related to the ICE 14 may be utilised for further adjusting the upper and lower control limit values by the application of third and fourth parameter limit values in the same manner as discussed herein in relation to other operational parameters.

Below, with reference to FIG. 4 the operational parameter and/or further operational parameter related to the measurements from the above mentioned rotational speed sensor of the turbocharger 52, pressure sensor of the turbocharger 52, temperature sensor of the turbocharger 52, temperature sensor of the cylinder arrangement 50, and pressure sensor of the combustion chamber 54 are discussed in the context of a method 100 for controlling a propulsive power output applied to a propeller shaft of a ship.

Figure 4:
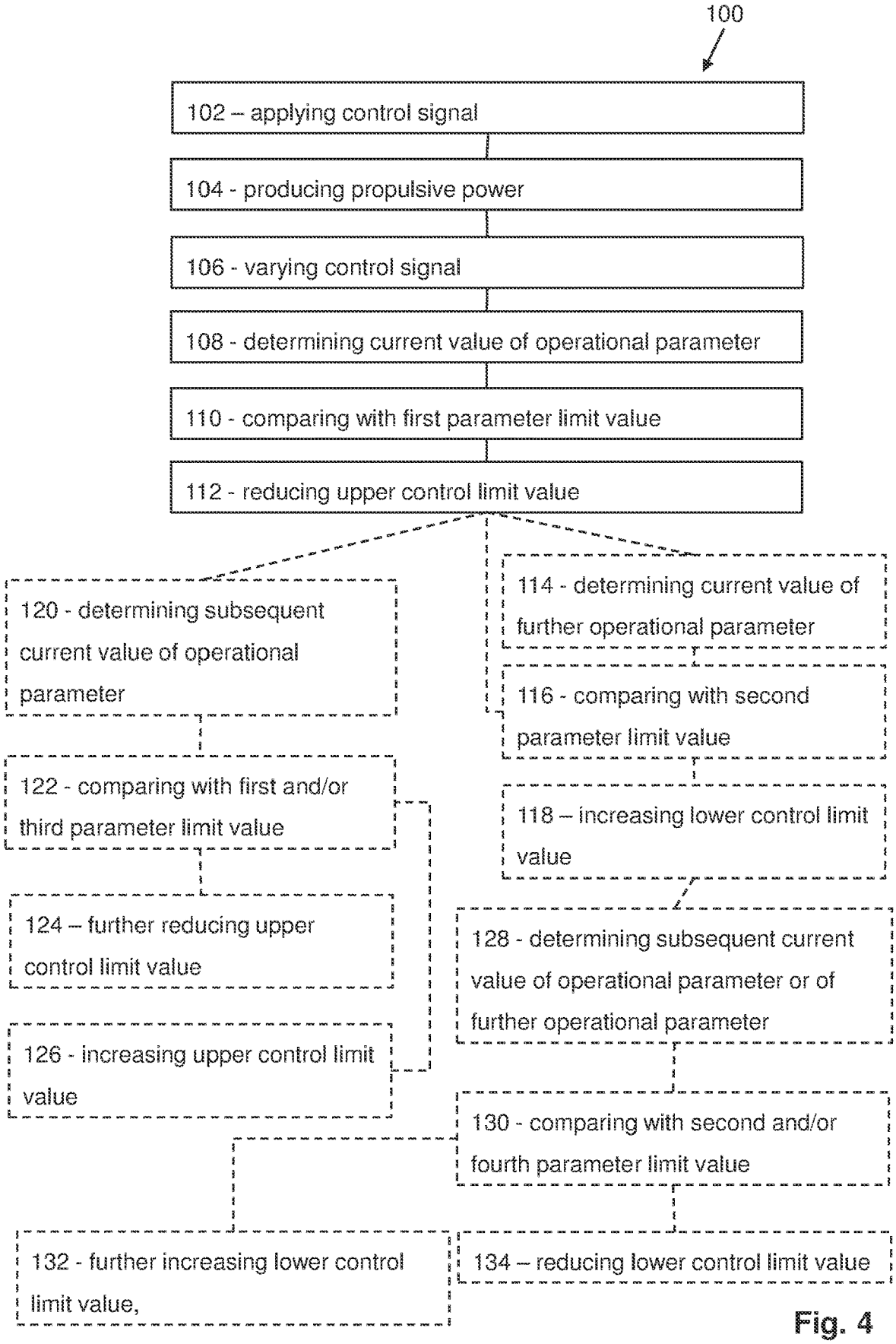
FIG. 4 illustrates a method for controlling a propulsive power output applied to a propeller shaft of a ship.

FIG. 4 illustrates a method 100 for controlling a propulsive power output applied to a propeller shaft of a ship.

The method 100 may be performed in connection with a ship 2 as discussed above with reference to FIG. 1, and a system 10 as discussed above in connection with FIGS. 2 and 3. Accordingly, in the following reference is also made to FIGS. 1-3. Thus, the ship 2 comprises a propulsive power source 4 and the propeller shaft 6. The propulsive power source 4 comprises an ICE 14 connected to the propeller shaft 6.

The method 100 comprises steps of:

- applying 102 a control signal to the propulsive power source,
- producing 104 with the propulsive power source a propulsive power in correspondence with the control signal,
- varying 106 the control signal within an interval limited by an upper control limit value and a lower control limit value,
- determining 108 a current value of an operational parameter of the ship 2,
- comparing 110 the current value of the operational parameter with a first parameter limit value, wherein if the current value of the operational parameter reaches the first parameter limit value, the method 100 comprises a step of:
- reducing 112 the upper control limit value.

As discussed above, in this manner applying a too high power output to the propeller shaft 6, which is unfavourable for the ship 2, is prevented or a risk thereof is at least reduced.

According to embodiments, the method 100 may comprise an optional step of:

- determining 114 a current value of a further operational parameter of the ship 2, and the method 100 may comprise a step of:
- comparing 116 the current value of the operational parameter or the current value of the further operational parameter with a second parameter limit value, wherein if the current value of the operational parameter or the current value of the further operational parameter reaches the second parameter limit value, the method 100 may comprise a step of:
- increasing 118 the lower control limit value.

As discussed above, in this manner applying a too low power output to the propeller shaft, which could be unfavourable for the ship, may be prevented or a risk thereof is at least reduced.

See also the discussion above, with reference to FIGS. 1-3.

According to embodiments, subsequent to the step of reducing 112 the upper control limit value the method 100 may comprise steps of:

- determining 120 a subsequent current value of the operational parameter of the ship 2,
- comparing 122 the subsequent current value of the operational parameter with the first parameter limit value and/or a third parameter limit value.

If the subsequent current value of the operational parameter reaches the first parameter limit value, the method 100 may comprise a step of:

further reducing 124 the upper control limit value, or if the subsequent current value of the operational parameter stays clear of the third parameter limit value, the method 100 may comprise a step of:

increasing 126 the upper control limit value.

As discussed above, in this manner the upper control limit value may be adapted to changing operating conditions of the ship 2. More specifically, the subsequent current value of the operational parameter of the ship 2 may represent current operating conditions of the ship. If the subsequent current value of the operational parameter has changed to such a degree that the first parameter limit value has been reached, or the third parameter limit value has not been reached, the upper control limit value may be either further reduced or increased. Accordingly, the size of the power window may be continuously or intermittently adapted to current operating conditions of the ship 2.

See also the discussion above, with reference to FIGS. 1-3.

According to embodiments, subsequent to the step of increasing 118 the lower control limit value the method 100 may comprise steps of:

determining 128 a subsequent current value of the operational parameter of the ship 2 or a subsequent current value of the further operational parameter of the ship 2, comparing 130 the subsequent current value of the operational parameter or the subsequent current value of the further operational parameter with the second parameter limit value and/or a fourth parameter limit value.

If the subsequent current value of the operational parameter or the subsequent current value of the further operational parameter reaches the second parameter limit value, the method 100 may comprise a step of:

further increasing 132 the lower control limit value, or if the subsequent current value of the operational parameter or the subsequent current value of the further operational parameter stays clear of the fourth parameter limit value, the method 100 may comprise a step of:

reducing 134 the lower control limit value.

As discussed above, in this manner, the lower control limit value may be adapted to changing operating conditions of the ship 2. More specifically, the subsequent current value of the operational parameter of the ship 2 or the subsequent value of the further operational parameter may represent current operating conditions of the ship 2. If the subsequent current value of the operational parameter or further operational parameter has changed to such a degree that the second parameter limit value has been reached or the fourth parameter limit value has not been reached, the lower control limit value may be either further increased or reduced. Accordingly, the size of the power window may be continuously or intermittently adapted to current operating conditions of the ship.

See also the discussion above, with reference to FIGS. 1-3.

Initially, the respective lower and upper control limit values may be starting values that may be set based e.g. on an available power output range of the propulsive power source 4. The above discussed reduction of the upper control limit value and increase of the lower control limit value entails that the respective upper and lower control limit values may be adapted to current operating conditions of the ship 2. Once normal operating conditions are again established for the ship 2, one or both of the upper and lower power limit values may be reset to the original starting values, or to new starting values corresponding to new requirements or desires, utilising the above discussed steps 124, 126, 132, 134.

According to embodiments, the operational parameter and/or the further operational parameter may relate to a load characteristic of the propeller shaft 6. In this manner, the characteristic related to load affecting the propeller shaft 6 of the ship 2 may be utilised for determining the operational parameter of the ship 2 and/or the further operational parameter of the ship 2 and for comparing the current value of the operational parameter and/or the further operational parameter with the first, second, third and/or fourth parameter limit value.

In the following, a few non-limiting examples of how the operational parameter of the ship 2 and/or the further operational parameter of the ship 2, may relate to a load characteristic of the propeller shaft 6, and the upper and lower control limit values. See also above with reference to FIGS. 2 and 3.

The operational parameter and/or the further operational parameter may relate to torque or changes in torque applied to the propeller shaft 6. The torque may be represented by actual torque data as provided e.g. by a torque meter 30, or as calculated from e.g. strain data, or the torque may be represented indirectly e.g. by torsional strain data as provided by a strain gauge 32. The first, second, third, and/or fourth parameter limit value may relate to e.g., one of a maximum permissible torque, minimum permissible torque or to impermissible changes in torque, such as an absolute value of a derivative of the torque applied to the propeller shaft 6 or a maximum amplitude of the changes in torque applied to the propeller shaft 6 over a time period. If such maximum permissible torque occurs or the impermissible changes in torque occur towards an upper range of available power output from the propulsive power source 4, they may relate to the first and third parameter limit values. If the minimum permissible torque occurs or the impermissible changes in torque occur towards a lower range of available power output from the propulsive power source 4, they may relate to the second and fourth parameter limit values.

The operational parameter and/or the further operational parameter may relate to changes in rotational speed of the propeller shaft 6 of the ship 2, and/or to a difference between a current rotational speed of the propeller shaft 6 and an expected rotational speed of the propeller shaft 6, the latter may correspond to an excessive propeller slip. The operational parameter and/or the further operational parameter may relate directly to the rotational speed of the propeller shaft 6 or indirectly via the rotational speed of the ICE 14. In the latter case the rotational speed of the ICE 14 correlates with the rotational speed of the propeller shaft 6.

The changes in rotational speed of the propeller shaft 6 of the ship 2 may indicate changes in the load affecting the propeller shaft 6. The first, second, third, and/or fourth parameter limit value may relate to impermissible changes in rotational speed, such as an absolute value of a derivative of the rotational speed or a maximum amplitude of the changes of the rotational speed over a time period. The difference between a current rotational speed of the propeller shaft 6 and an expected rotational speed of the propeller shaft 6 may indicate a difference between a current load affecting the propeller shaft 6 and an expected load affecting the propeller shaft 6. The first, second, third and/or fourth parameter limit value may relate to a difference between a current rotational speed and an expected rotational speed.

If impermissible changes in rotational speed occur towards an upper range of available power output from the propulsive power source 4, they may relate to the first and third parameter limit values. If the impermissible changes in rotational speed occur towards a lower range of available power output from the propulsive power source 4, they may relate to the second and fourth parameter limit values.

If a difference between a current rotational speed and an expected rotational speed reaches a maximum value as represented by the first and/or second parameter limit value, towards an upper range of available power output from the propulsive power source 4 the upper control limit value may be reduced, and towards a lower range of available power output from the propulsive power source 4 the lower control limit value may be increased. If a difference between a current rotational speed and an expected rotational speed stays clear of a minimum value as represented by the third parameter limit value towards an upper range of available power output from the propulsive power source 4, the upper control limit value may be increased, and as represented by the fourth parameter limit value towards a lower range of available power output from the propulsive power source 4, the lower control limit value may be reduced.

The operational parameter and/or the further operational parameter may relate to a difference between a current speed of the ship 2 and an expected speed of the ship 2. The difference between a current speed and an expected speed of the ship 2 may indicate a difference between a current load affecting the propeller shaft 6 and an expected load affecting the propeller shaft 6.

If a current value of the operational parameter and/or the further operational parameter, as represented by a current value of a difference between a current speed of the ship 2 and an expected speed of the ship 2 (current speed−expected speed), reaches a maximum negative value (i.e. the ship 2 is traveling slower than expected) as represented by the first parameter limit value, the upper control limit value may be reduced in order to prevent inefficient propulsion of the ship. If a current value of the operational parameter and/or the further operational parameter, as represented by a current value of the difference between a current speed of the ship 2 and an expected speed of the ship 2, reaches a maximum positive value (i.e. the ship is traveling faster than expected) as represented by the second parameter limit value, the lower control limit value may be increased in order to take advantage of the good traveling conditions of the ship.

If a current value of the operational parameter and/or the further operational parameter, as represented by a current value of a difference between a current speed of the ship 2 and an expected speed of the ship 2, stays clear of a minimum negative value (i.e. the ship 2 is traveling only slightly slower than expected, as expected, or faster than expected) as represented by the third parameter limit value, the upper control limit value may be increased. If a current value of the operational parameter and/or the further operational parameter, as represented by a current value of a difference between a current speed of the ship 2 and an expected speed of the ship 2, stays clear of a minimum positive value (i.e. the ship is traveling only slightly faster than expected, as expected, or slower than expected) as represented by the fourth parameter limit value, the lower control limit value may be reduced.

According to embodiments, the operational parameter and/or the further operational parameter may relate to ambient conditions affecting the ship 2. In this manner, the characteristic related to ambient conditions affecting the ship 2 may be utilised for determining the current value of the operational parameter of the ship 2 and/or the further operational parameter of the ship 2 and for comparing the current value of the operational parameter and/or the further operational parameter with the first, second, third, and/or fourth parameter limit value.

In the following a few non-limiting examples of how ambient conditions affecting the ship 2 may relate to the operational parameter of the ship 2 and/or the further operational parameter of the ship 2, and the upper and lower control limit values. See also above with reference to FIGS. 2 and 3.

The operational parameter of the ship 2 may relate to the angle of list of the ship 2 and the first and/or third parameter limit value may relate to a maximum angle of list of the ship 2. If a current value of the operational parameter, as represented by a current value of the angel of list of the ship 2 reaches the maximum angle of list of the ship 2, the upper control limit value may be reduced. The third parameter limit value may relate to a further maximum angle of list of the ship 2. If a current value of the operational parameter, as represented by a current value of the angel of list of the ship 2 stays clear of the further maximum angle of list of the ship 2, the upper control limit value may be increased.

The operational parameter may relate to wind strength and/or wind direction and the first parameter limit value may relate e.g. to a maximum limit wind strength, optionally in combination with particular wind directions. For instance, if a current value of the operational parameter, as represented by a current value of the wind strength reaches the maximum limit wind strength, the upper control limit value may be reduced. The third parameter limit value may relate to a lower limit wind strength. If a current value of the operational parameter, as represented by a current value of the wind strength, stays clear of the lower limit wind strength, the upper control limit value may be increased.

The operational parameter and the first parameter limit value may relate to accelerations and/or forces acting on the ship 2 and/or its crew and/or its cargo. The first parameter limit value may relate to a maximum acceleration and/or a maximum force. If a current value of the operational parameter, as represented by a current value of the acceleration or a force, reaches the maximum acceleration or the maximum force, the upper control limit value may be reduced. The third parameter limit value may relate to a lower acceleration or a lower force. If a current value of the operational parameter, as represented by a current value of the acceleration or a force, stays clear of the lower acceleration or lower force, the upper control limit value may be increased.

The operational parameter and the first parameter limit value may relate to a minimum sea depth. The first parameter limit value may relate to a first minimum sea depth. If a current value of the operational parameter, as represented by a current value of the sea depth, reaches the first minimum sea depth, the upper control limit value may be reduced. The third parameter limit value may relate to a second minimum sea depth. The second minimum sea depth is deeper than the first minimum sea depth. If a current value of the operational parameter, as represented by a current value of the sea depth, stays clear of the second minimum sea depth, the upper control limit value may be increased.

According to embodiments, the operational parameter and/or the further operational parameter may relate to a cargo load characteristic affecting cargo aboard the ship 2. In this manner, the characteristic related to the cargo load affecting the cargo 40 aboard the ship 2 may be utilised for determining the current value of the operational parameter of the ship and for comparing the current value of the operational parameter with the first parameter limit value.

The operational parameter may relate to the strain affecting the cargo 40. Accordingly, the first parameter limit value may relate to e.g., a first maximum strain affecting the cargo 40. If a current value of the operational parameter, as represented by a current value of the strain affecting the cargo 40, reaches the first maximum strain, the upper control limit value may be reduced. The third parameter limit value may relate to a second maximum strain affecting the cargo 40. The second maximum strain is lower than the first maximum strain. If a current value of the operational parameter, as represented by a current value of the strain affecting the cargo 40, stays clear of the second maximum force, the upper control limit value may be increased.

The operational parameter and the first parameter limit value may relate to accelerations and/or forces acting on the cargo 40. The first parameter limit value may relate to a first maximum acceleration and/or a first maximum force. If a current value of the operational parameter, as represented by a current value of the acceleration or of a force, reaches the first maximum acceleration or the first maximum force, the upper control limit value may be reduced. The third parameter limit value may relate to a second maximum acceleration or to a second maximum force. The second maximum acceleration is lower than the first maximum acceleration, and the second maximum force is lower than the first maximum force. If a current value of the operational parameter, as represented by a current value of the acceleration or of a force, stays clear of the second maximum acceleration or the second maximum force, the upper control limit value may be increased.

The operational parameter and/or the further operational parameter and the first parameter limit value and/or the second parameter limit value may relate to vibrations affecting the cargo 40. The first parameter limit value and/or the second parameter limit value may relate to a first maximum vibration level. If the current value of the operational parameter, as represented by a current value of the vibrations affecting the cargo 40, reaches the first maximum vibration level, the upper control limit value may be reduced, or the lower control limit value may be increased, depending on whether the propulsive power source 4 is operated near its upper maximum power output or near its lower minimum power output. The third and/or fourth parameter limit values may relate to a second maximum vibration level. The second maximum vibration level is lower than the first maximum vibration level. If a current value of the operational parameter, as represented by a current value of the vibrations affecting the cargo 40, reaches the second maximum vibration level, the upper control limit value may be increased, or the lower control limit value may be reduced, depending on whether the propulsive power source is operated near its upper maximum power output or near its lower minimum power output.

As discussed above, the propulsive power source 4 may comprise an internal combustion engine 14 connected to the propeller shaft 6 and the operational parameter and/or the further operational parameter may relate to the internal combustion engine 14. In this manner, operating conditions of the internal combustion engine may be considered when setting the upper and/or lower control limit value/s. Further, as also discussed above, the internal combustion engine 14 may comprise at least one cylinder arrangement 22 and a turbocharger 24. The cylinder arrangement 22 comprises a combustion chamber 26, a cylinder bore 28, a piston 30 configured to reciprocate in the cylinder bore 28, a gas inlet 32 connected to the combustion chamber 26, and a gas outlet 34 connected to the combustion chamber 26. The gas outlet 34 is connected to a turbine 64 of the turbocharger 24 and the gas inlet 32 is connected to a compressor 66 of the turbocharger 24. The operational parameter and/or the further operational parameter relates to the turbocharger 24, and/or to the cylinder arrangement 22.

According to embodiments, of the method 100 the operational parameter and/or the further operational parameter may relate to one of:

- a rotational speed of the turbocharger 24,
- a temperature at the inlet at the turbine 64 of the turbocharger 24,
- a temperature at an outlet at the turbine 64 of the turbocharger 24,
- a pressure at the outlet at the compressor 66 of the turbocharger 24. In this manner, such parameters may be utilised in the method 100. See above with reference to FIGS. 2 and 3 for examples of their application and relation to the first parameter limit value and/or the second parameter limit value and the upper and/or lower control limit value.

According to embodiments, of the method 100, the operational parameter and/or the further operational parameter may relate to one of:

- a temperature of the cylinder arrangement 22, or
- a pressure within the combustion chamber. In this manner, such parameters may be utilised in the method 100. See above with reference to FIGS. 2 and 3 for examples of their application and relation to the first parameter limit value and/or the second parameter limit value and the upper and/or lower control limit value.

According to embodiments, of the method 100, the operational parameter and/or the further operational parameter may relate to one of:

- an absolute value of a derivative of the rotational speed of the turbocharger 24,
- a variation of an amplitude of the rotational speed of the turbocharger 24,
- an absolute value of a derivative of the pressure at the outlet at the compressor 66 of the turbocharger 52,
- a variation of an amplitude of the pressure at the outlet at the compressor 66 of the turbocharger 24. In this manner, such parameters may be utilised in the method 100. See above with reference to FIGS. 2 and 3 for examples of their application and relation to the first parameter limit value and/or the second parameter limit value and the upper and/or lower control limit value.

As mentioned above with respect to ambient conditions affecting the ship 2 and ideal weather conditions, but which also may apply in a more general manner to other operational parameters, in certain instances the lower control limit value may be set to relate to average conditions affecting the ship 2. If conditions are better than average, as determined in the comparison of the current value of the operational parameter or the current value of the further operational parameter with the second parameter limit value, the lower control limit value may be increased, e.g. in order to take advantage of the better than average conditions in order to travel with the propulsive power source operating efficiently and/or in an environmentally friendly manner.

The same may apply to the upper control limit value, which in certain instances may be set to relate to average conditions affecting the ship 2. If conditions are better than average, as determined in the comparison of the current value of the operational parameter with the first parameter limit value, the upper control limit value may be increased, e.g. in order to take advantage of the better than average conditions in order to travel with the propulsive power source operating efficiently and/or in an environmentally friendly manner.

Naturally, more than one or two of the above discussed operational parameters of the ship 2 and/or further operational parameters of the ship 2 may be determined and compared to respective parameter limit values. Whereas under some operating conditions of the ship 2 a particular operational parameter of the ship 2 may indicate that the ship 2 is operated at the first or second parameter limit value, under other operating conditions, a different operational parameter may indicate that the ship 2 is operated at the first or second parameter limit value.

According to a further aspect, there is provided a computer program comprising instructions which, when the program is executed by a computer, causes the computer to carry out a method 100 according to any one of aspects and/or embodiments discussed herein.

One skilled in the art will appreciate that the method 100 for controlling a propulsive power output applied to a propeller shaft 6 of a ship 2 may be implemented by programmed instructions. These programmed instructions are typically constituted by a computer program, which, when it is executed in a computer or calculation unit of the control unit, ensures that the computer or calculation unit carries out the desired control, such as the method 100, and thereto related steps 102-134. The computer program is usually part of a computer-readable storage medium which comprises a suitable digital storage medium on which the computer program is stored.

FIG. 5 illustrates embodiments of a computer-readable storage medium 90 comprising instructions which, when executed by a computer, cause the computer to carry out the steps of the method 100 according to any one of aspects and/or embodiments discussed herein.

The computer-readable storage medium 90 may be provided for instance in the form of a data carrier carrying computer program code for performing at least some of the steps 102-134 according to some embodiments when being loaded into the one or more calculation units of the control unit 16. The data carrier may be, e.g. a ROM (read-only memory), a PROM (programmable read-only memory), an EPROM (erasable PROM), a flash memory, an EEPROM (electrically erasable PROM), a hard disc, a CD ROM disc, a memory stick, an optical storage device, a magnetic storage device or any other appropriate medium such as a disk or tape that may hold machine readable data in a non-transitory manner. The computer-readable storage medium may furthermore be provided as computer program code on a server and may be downloaded to the control unit 16 remotely, e.g., over an Internet or an intranet connection, or via other wired or wireless communication systems.

The computer-readable storage medium 90 shown in FIG. 5 is a nonlimiting example in the form of a USB memory stick.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the invention, as defined by the appended claims.

The invention claimed is:

1. A system for controlling a propulsive power output applied to a propeller shaft of a ship, the system comprising:

a propulsive power source comprising an internal combustion engine connected to the propeller shaft, the internal combustion engine including at least one cylinder arrangement and a turbocharger, the at least one cylinder arrangement including a combustion chamber, a cylinder bore, a piston configured to reciprocate in the cylinder bore, a gas inlet connected to the combustion chamber, and a gas outlet connected to the combustion chamber, wherein the gas outlet is connected to a turbine of the turbocharger and the gas inlet is connected to a compressor of the turbocharger; and a control arrangement including at least one processor and at least one sensor for sensing at least one operational characteristic of the ship, the control arrangement being configured to:

apply a control signal to the propulsive power source for controlling the propulsive power output applied to the propeller shaft by the propulsive power source, wherein the control signal is variable within an interval limited by an upper control limit value and a lower control limit value when the ship is travelling, determine a current value of an operational parameter of the ship utilizing the at least one sensor, the operational parameter being one of an absolute value of a derivative of a rotational speed of the turbocharger, a variation of an amplitude of the rotational speed of the turbocharger, an absolute value of a derivative of a pressure at the outlet at the compressor of the turbocharger, or a variation of an amplitude of the pressure at the outlet at the compressor of the turbocharger, compare the current value of the operational parameter with a first parameter limit value, and reduce the upper control limit value when the current value of the operational parameter reaches the first parameter limit value.

2. The system according to claim 1, wherein the control arrangement is further configured to:

determine a subsequent current value of the operational parameter of the ship utilizing the at least one sensor, compare the subsequent current value of the operational parameter with the first parameter limit value and/or a third parameter limit value, and change the upper control limit value by further reducing the upper control limit value when the subsequent current value of the operational parameter reaches the first parameter limit value or by increasing the upper control limit value when the subsequent current value of the operational parameter stays clear of the third parameter limit value.

3. The system according to claim 1, wherein the control arrangement is configured to:

determine a current value of a further operational parameter of the ship utilizing the at least one sensor, compare the current value of the operational parameter or the current value of the further operational parameter with a second parameter limit value, and increase the lower control limit value when the current value of the operational parameter or the current value of the further operational parameter reaches the second parameter limit value.

4. The system according to claim 3, wherein the control arrangement is configured to:

determine a subsequent current value of the operational parameter of the ship or a subsequent current value of the further operational parameter of the ship, and compare the subsequent current value of the operational parameter or the subsequent current value of the further operational parameter with the second parameter limit value and/or a fourth parameter limit value, and change the lower control limit value by further increasing the lower control limit value when the subsequent current value of the operational parameter or the subsequent current value of the further operational parameter reaches the second parameter limit value or by reducing the lower control limit value when the subsequent current value of the operational parameter or the subsequent current value of the further operational parameter stays clear of the fourth parameter limit value.

5. The system according to claim 1, wherein the at least one sensor for sensing the at least one operational characteristic of the ship includes at least one of an inclination sensor, an anemometer, an accelerometer, or a depth sounding sensor configured for sensing a characteristic related to an ambient condition affecting the ship.

6. The system according to claim 1, wherein the at least one sensor for sensing the at least one operational characteristic of the ship is further configured for sensing a characteristic related to a load affecting the propeller shaft.

7. The system according to claim 6, wherein the at least one sensor for sensing the at least one operational characteristic of the ship includes a strain gauge or an accelerometer configured for sensing a cargo load characteristic affecting cargo aboard the ship.

8. The system according to claim 1, wherein the at least one sensor comprises:

a rotational speed sensor of the turbocharger, a pressure sensor of the turbocharger, a temperature sensor of the turbocharger, a temperature sensor of the cylinder arrangement, or a pressure sensor of the combustion chamber.

9. A ship comprising the system according to claim 1.

10. A method for controlling the propulsive power output applied to the propeller shaft of the ship in the system according to claim 1, comprising steps of:

applying the control signal to the propulsive power source, producing with the propulsive power source a propulsive power in correspondence with the control signal, and varying the control signal within the interval limited by the upper control limit value and the lower control limit value, the step of varying the control signal within the interval limited by the upper and lower control limit values being performed when the ship travels, determining the current value of the operational parameter of the ship, comparing the current value of the operational parameter with the first parameter limit value, and reducing the upper control limit value when the current value of the operational parameter reaches the first parameter limit value.

11. The method according to claim 10, wherein subsequent to the step of reducing the upper control limit value the method comprises steps of:

determining a subsequent current value of the operational parameter of the ship, comparing the subsequent current value of the operational parameter with the first parameter limit value and/or a third parameter limit value, and changing the upper control limit value by further reducing the upper control limit value when the subsequent current value of the operational parameter reaches the first parameter limit value or increasing the upper control limit value when the subsequent current value of the operational parameter stays clear of the third parameter limit value.

12. The method according to claim 10, comprising a step of:

determining a current value of a further operational parameter of the ship, comparing the current value of the operational parameter or the current value of the further operational parameter with a second parameter limit value, and increasing the lower control limit value when the current value of the operational parameter or the current value of the further operational parameter reaches the second parameter limit value.

13. The method according to claim 12, wherein subsequent to the step of increasing the lower control limit value the method comprises steps of:

determining a subsequent current value of the operational parameter of the ship or a subsequent current value of the further operational parameter of the ship, and comparing the subsequent current value of the operational parameter or the subsequent current value of the further operational parameter with the second parameter limit value and/or a fourth parameter limit value, and changing the lower control limit value by further increasing the lower control limit value when the subsequent current value of the operational parameter or the subsequent current value of the further operational parameter reaches the second parameter limit value or by reducing the lower control limit value when the subsequent current value of the operational parameter or the subsequent current value of the further operational parameter stays clear of the fourth parameter limit value.

14. The method according to claim 12, wherein the further operational parameter of the ship relates to a load characteristic of the propeller shaft.

15. The method according to claim 12, wherein the further operational parameter of the ship relates to ambient conditions affecting the ship.

16. The method according to claim 12, wherein the further operational parameter of the ship relates to one of:

a rotational speed of the turbocharger, a temperature at the inlet at the turbine of the turbocharger, a temperature at an outlet at the turbine of the turbocharger, or a pressure at the outlet at the compressor of the turbocharger.

17. The method according to claim 12, wherein the further operational parameter of the ship relates to one of:

a temperature of the cylinder arrangement, or a pressure within the combustion chamber.

18. The method according to claim 12, wherein the further operational parameter of the ship relates to a cargo load characteristic affecting cargo aboard the ship.

19. A non-transitory computer-readable storage medium comprising computer-readable instructions executable by a computer to cause the computer to carry out the steps of the method according to claim 12.

* * * * *